United States Patent [19]

Weingart

[11] Patent Number: 4,492,310

[45] Date of Patent: Jan. 8, 1985

[54] APPARATUS AND METHOD FOR LOADING AND UNLOADING CARGO LIGHTERS ON OR FROM SHIPS

[75] Inventor: Brooks E. Weingart, Alliance, Ohio

[73] Assignee: AMCA International Corporation, Hanover, N.H.

[21] Appl. No.: 365,916

[22] Filed: Apr. 6, 1982

[51] Int. Cl.[3] ..... B63B 35/40

[52] U.S. Cl. ..... 212/191; 212/147; 114/260

[58] Field of Search ..... 212/190, 191, 146, 147, 212/208, 213, 220, 221; 114/260, 268

[56] References Cited

U.S. PATENT DOCUMENTS

| | | | |
|---|---|---|---|
| 3,021,963 | 2/1962 | Kasdorf et al. | 212/221 |
| 3,390,657 | 7/1968 | Schneider | 114/268 |
| 3,469,716 | 9/1969 | Auzins et al. | 212/147 |
| 3,515,085 | 6/1970 | Auzins | 114/260 |
| 3,515,086 | 6/1970 | Auzins et al. | 114/268 |
| 3,536,204 | 10/1970 | Auzins | 212/190 |
| 3,572,274 | 3/1971 | Braur et al. | 114/260 |
| 3,661,279 | 5/1972 | Macrander | 114/260 |
| 4,094,493 | 6/1978 | Polen | 212/190 |
| 4,292,915 | 10/1981 | Nemec et al. | 114/260 |
| 4,316,528 | 2/1982 | Dechantsreiter | 212/213 |

FOREIGN PATENT DOCUMENTS

| | | | |
|---|---|---|---|
| 2430387 | 3/1980 | France | 212/147 |
| 178079 | 11/1966 | U.S.S.R. | 212/221 |

OTHER PUBLICATIONS

"Engineering a 510-Ton LASH Crane", by R. Auzins, in Iron and Steel Engineer, Jul. 1970, pp. 86–93.

*Primary Examiner*—Sherman D. Basinger
*Assistant Examiner*—Thomas J. Brahan
*Attorney, Agent, or Firm*—Maky, Renner, Otto & Boisselle

[57] ABSTRACT

A system is disclosed for transporting a lighter 136 from a floating position adjacent the stern 130 of ship 101 to a storage position in the cargo hold 138 of said ship, and for transporting lighter 136 from said storage position to said floating position. The system includes crane 102 which is adapted for fore and aft travel along spaced rails 104 and 106 which extend longitudinally along opposite sides of ship 101 and for hoisting lighter 136, and load frame 172 which is suspended by crane 102 and adapted for attachment to lighter 136. Vertically extendable and retractable load frame guide members 108, 110, 112 and 114 depend from crane 102. Removable aft guide members 118 and 120 are mountable on cantilevered beams 122 and 124. Removable fore guide members 126 and 128 are mountable on stern 130. Guide members 118 and 120 are adapted for being positioned below and coaxially aligned with guide members 108 and 110. Guide members 126 and 128 are adapted for being positioned below and coaxially with guide members 112 and 114. Fixed fore guide members 132 and 134 are mounted on stern 130 and adapted for being positioned below and coaxially aligned with guide members 126 and 128. Guide members 108, 110, 112, 114, 118, 120, 126, 128, 132 and 134 are adapted for retaining the swinging movement of load frame 172 when lighter 136 is hoisted by crane 102.

35 Claims, 32 Drawing Figures

101
104
106
136
138
102
266
178
244
252
180
264
770
170
184
186
122
701
258
182
192
100
250
254
191
256
703
124
812
475
477
116
114
166
400
128
134
174
390
246
110
120
162
172

4
4
5
5
7
7
2
2
101
102
100
104
106
108
110
116
118
120
122
124
126
130
132
134
136
138
140
142
150
152
160
162
170
172
182
184
186
244
250
256
258
262
350
354
356
360
390
394
420
422
424
454
475
476
477
478
530
641
642
644
646
652
654
672
674
676
678
686
688
690
812
840
842

APPARATUS AND METHOD FOR LOADING AND UNLOADING CARGO LIGHTERS ON OR FROM SHIPS

TECHNICAL FIELD

This invention relates to transport systems wherein cargo is loaded in cargo lighters or barges which are floated to a ship, lifted from the water and deposited in the cargo hold of the ship by a crane carried on the ship, and subsequently unloaded in the reverse manner when the ship reaches its destination. More particularly, this invention relates to a system for lifting, guiding and securing cargo lighters while the lighters are being placed aboard or overboard. The cargo handling systems of this invention are particularly suitable for use with ships of the type with open stern walls that optionally permit loading and unloading of a first layer of such lighters by partially submerging the ship sufficiently to permit lighters to be floated into or out of the cargo hold of the ship.

BACKGROUND OF THE INVENTION

Ships of the type with open stern walls are in common usage for transporting cargo lighters from one location to another. These ships are generally of a dual hull design that includes a system of ballast tanks that permit the ship to operate in a partially submerged or a fully floating mode. A first layer of lighters can be loaded on such ships by initially partially submerging the ship, floating the lighters into the cargo hold through the open stern wall, securing the lighters in place and then raising the ship to its floating position by evacuating the ballast tanks. The lighters are subsequently unloaded in the reverse manner when the ship reaches its destination. The lighters used in connection with such ships generally have a cargo carrying capacity of up to about 350 tons and a combined maximum weight including cargo of up to about 500 tons. Ships of this type typically carry about twenty or thirty lighters and are commonly used in inland waterways, but not generally used as ocean-going vessels.

Ocean-going transport systems have been provided wherein cargo is loaded in lighters which are floated to a ship. The lighters are lifted from the water and deposited in the cargo hold of the ship by a crane carried on the ship and subsequently unloaded in the reverse manner when the ship reaches its destination. The ocean-going cargo ships employed with such systems generally have a cargo handling capacity of about 90 to about 100 lighters and are of conventional hull design with entirely enclosed cargo holds and hatch covers for sealing such cargo holds. For example, U.S. Pat. No. 3,390,657 describes a gantry crane adapted for operation on a vessel to lift lighters and transport them from an outboard loading position astern the vessel to and through a hatch and into a cargo hold, the crane being located for travel on spaced rails extending longitudinally along opposite sides of the ship. The ship is disclosed as having spaced cantilevered stern beams which provide a platform on which the crane may travel to an outboard position for lifting a floating lighter from the water. The crane is used to lift the lighter out of the water vertically upward to a position above the cargo hatches of the ship and to transport the lighter to a particular cargo hatch and lower it into the cargo hold for storage. U.S. Pat. Nos. 3,469,716 and 3,515,086 describe a sea-going transport system that includes in combination with a gantry crane mounted on the deck of a ship a guide system for restraining swinging movement of lighters being transported from a floating position adjacent the stern of the ship to a storage position in the cargo hold of the ship. The guide system described in these patents includes a pair of lead-in stern guides pivotally depending from a pair of parallel spaced cantilevered stern beams which project horizontally from the stern of the ship, and a guide-rail-guide-carriage arrangement mounted on the legs of the gantry crane and adapted for restraining swinging movement U.S. Pat. No. 3,515,085 describes a load frame assembly for use with a sea-going transport system which includes a collapsible member for each ropefall of the hoisting system to maintain tension in the ropefalls when the lighter is tossed by sea swells. U.S. Pat. No. 3,536,204 describes an anchoring device for securing a traveling ship-board crane to the deck of the ship.

It would be advantageous to provide a system for transporting lighters from a floating position adjacent the stern of a ship to a storage location aboard said ship or for transporting such lighters from said storage location to said floating position that would be suitable for use with ships of the open stern wall type. Such a system would necessarily include guide members for restraining the swinging movement of the lighters when loading and unloading such lighters using the crane of the systems. However, such guide members would have to be designed in such a manner so as to also permit the loading and unloading of lighters by floating such lighters into or out of the cargo hold. It would be advantageous if such a system were of a simplified design and construction relative to the transport systems designed for use with conventional ocean-going cargo vessels.

SUMMARY OF THE INVENTION

Transport systems of the type illustrated in the drawings and hereinafter described are particularly suitable for use with ships of the open stern wall type. These systems include guide members for restraining the swinging movement of lighters being loaded and unloaded using the crane of the system that can be facilitatingly removed to permit the loading or unloading of lighters by floating such lighters into or out of the cargo hold. These systems are simplified in design and construction in comparison to the transport systems designed for use with conventional ocean-going vessels.

The present invention contemplates the provision of a shipboard crane for transporting a cargo lighter from a floating position adjacent the stern of a ship to a storage location aboard said ship or for transporting said lighter from said storage location to said floating position comprising: a hoist support structure of sufficient transverse dimension to span the width of the cargo hold of said ship; means including wheel means for moving said hoist support structure fore and aft along spaced rails extending longitudinally along opposite sides of said ship; hoisting means mounted on said hoist support structure; a load frame suspended by said hoisting means, said load frame being adapted for attachment to said lighter; and vertically extendable and retractable load frame guide means depending from said hoist support structure, said guide means being adapted for guiding the hoisting movement and restraining the swinging movement of said lighter when said lighter is hoisted.

Further, the invention contemplates the provision of a system for transporting a lighter from a floating position adjacent the stern of a ship to a storage location aboard said ship or for transporting said lighter from said storage location to said floating position comprising: a crane comprising a hoist support structure of sufficient transverse dimension to span the width of the cargo hold of said ship, means including wheel means for moving said hoist support structure fore and aft along spaced rails extending longitudinally along opposite sides of said ship, hoisting means mounted on said hoist support structure and a load frame suspended by said hoisting means and being adapted for attachment to said lighter; vertically extendable and retractable load frame guide means depending from said hoist support structure, said extendable and retractable guide means including extendable and retractable aft guide members and extendable and retractable fore guide members; removable guide means removably mounted on said ship, said removable guide means including removable aft guide members removably mountable on cantilevered beams extending rearwardly from the stern of said ship and removable fore guide members removably mountable on the stern of said ship, said removable aft guide members adapted for being positioned below and coaxially aligned with said extendable and retractable aft guide members, and said removable fore guide members adapted for being positioned below and coaxially aligned with said extendable and retractable fore guide members; and fixed guide means mounted on the stern of said ship, said fixed guide means including fixed fore guide members adapted for being positioned below and coaxially aligned with said removable fore guide members; said vertically extendable and retractable load frame guide means, said removable guide means and said fixed guide means being adapted for guiding the hoisting movement and restraining the swinging movement of said lighter when said lighter is hoisted.

Further, the invention contemplates the provision of a method for transporting a lighter from a floating position adjacent the stern of a ship to a storage location in the cargo hold of said ship comprising the steps of: (a) providing the transport system of the present invention, which includes the crane of the present invention, said transport system being mounted for use on said ship, said ship including cantilevered beams extending rearwardly from the stern of said ship to provide a platform for the crane of said system to travel to an outboard position, the space below said cantilevered beams defining a loading well; (b) positioning the crane of said system at said outboard position over said loading well, the vertically extendable and retractable load frame guide means of said crane being vertically extended downwardly, and the removable guide means of said system being mounted on said ship; (c) floating a lighter into said loading well; (d) lowering said load frame into contacting engagement with said lighter, said load frame being initially guided by said vertically extendable and retractable load frame guide means then by said removable guide means as it is lowered; (e) although said load frame to said lighter; (f) hoisting said lighter to a position above said removable fore guide members, said load frame being guided by said removable guide means then by said vertically extendable and retractable load frame guide means as it is hoisted upwardly; (g) moving said crane forward along said spaced rails until said lighter is suspended over a desired storage location within the cargo hold of said ship; (h) lowering said lighter to said desired storage location, the swinging movement of said lighter being substantially restrained by said extended vertically extendable and retractable guide means; (i) removing said load frame from said lighter; (j) retracting said vertically extendable and retractable load frame guide means upwardly; (k) moving said crane rearwardly to the outboard position over said loading well; and (l) repeating steps (b) to (k) until all of the lighters desired for storage have been transported into said cargo hold. Advantageously, the foregoing method is performed with a ship of the open stern wall type, said method comprising the following additional steps subsequent to step (a), but prior to step (b): (aa) positioning the crane of said system in an anchoring position on the deck of said ship, the removable guide means of said system being removed from the loading well of said ship; (bb) submerging said ship sufficiently to provide a level of water in the cargo hold of said ship to permit lighters to float into said cargo hold; (cc) floating lighters into said cargo hold to provide a first layer of lighters in said cargo hold; (dd) securing the lighters in said first layer to said cargo hold; (ee) raising said ship to its floating position; (ff) mounting said removable guide means on said ship; and (gg) transporting additional lighters into the cargo hold of said ship by performing steps (b) to (l) until all of the lighters desired for storage have been transported into said cargo hold.

Further, the present invention contemplates the provision of a method for transporting a lighter from a storage location in the cargo hold of a ship to a floating position adjacent the stern of said ship comprising the steps of: (a) providing the transport system of the present invention, which includes the crane of the present invention, mounted for use on said ship, said ship including cantilevered beams extending rearwardly from the stern of said ship to provide a platform for the crane of said ship to travel to an outboard position, the space below said cantilevered beams defining a loading well; (b) mounting the removable guide means of said system on said ship; (c) positioning the crane of said system over a lighter in the cargo hold of said ship and extending the vertically extendable and retractable load frame guide means of said crane downwardly; (d) lowering said load frame into contacting engagement with said lighter, said load frame being guided by said extended vertically extendable and retractable load frame guide means; (e) attaching said load frame to said lighter; (f) hoisting said lighter to a position above any lighters stored in said cargo hold rearwardly of the lighter being hoisted, said load frame being guided by said extended vertically extendable and retractable load frame guide means; (g) moving said crane rearwardly along said spaced rails until said crane is positioned over said loading well, the swinging movement of said lighter being substantially restrained by said extended vertically extendable and retractable guide means; (h) lowering said lighter into a floating position in said loading well, said load frame being initially guided by said extended vertically extendable and retractable load frame guide means and then by said removable guide means; (i) removing said load frame from said lighter; (j) floating said lighter away from said loading well; (k) retracting said vertically extendable and retractable load frame guide means upwardly; (l) moving said crane forwardly to a position over the next lighter in the cargo hold to be unloaded; and (m) repeating steps (c) to (l) until all of the lighters desired to be removed from said cargo hold with said system have been removed. Advantageously, the foregoing method is employed with a ship of the open stern wall type that contains a first layer of lighters positioned on the floor of said cargo hold and one or more additional layers of lighters positioned on top of said first layer of lighters, and steps (c) to (m) of this method are performed until all of the cargo lighters in said additional layers have been removed from said cargo hold, the method then further comprising the following additional steps: (n) positioning the crane of said system in an anchoring position on the deck of said ship; (o) removing said removable guide means from their installed position; (p) submerging said ship sufficiently to provide a level of water in the cargo hold of said ship to permit the lighters of said first layer to float in said cargo hold; and (q) floating the lighters in said first layer out of said cargo hold.

It will be understood that terms such as "fore" or "forward" and "aft" or "rearward" as well as "port" and "starboard" herein designate locations or directions on or with respect to the crane or transport system of the present invention, when such crane or transport system is mounted for use on a ship.

BRIEF DESCRIPTION OF THE DRAWINGS

In the annexed drawings, like references indicate like parts or features:

FIG. 27 is a fragmentary plan view taken from the same perspective as FIG. 25 illustrating the engagement between two of the corners of the load frame suspended from the transport system of FIG. 1 and two of the guide members of the transport system of FIG. 1 provided for restraining the swinging movement of such load frame during the hoisting of such load frame;

FIG. 28 is a fragmentary sectional elevational view of an open stern wall ship illustrating a set of lighter centering guides used in the cargo hold of such ship in accordance with an alternate embodiment of the present invention;

FIG. 29 is a fragmentary sectional view taken along line 29—29 of FIG. 28;

DESCRIPTION OF THE PREFERRED EMBODIMENT

Figures 1, 2:
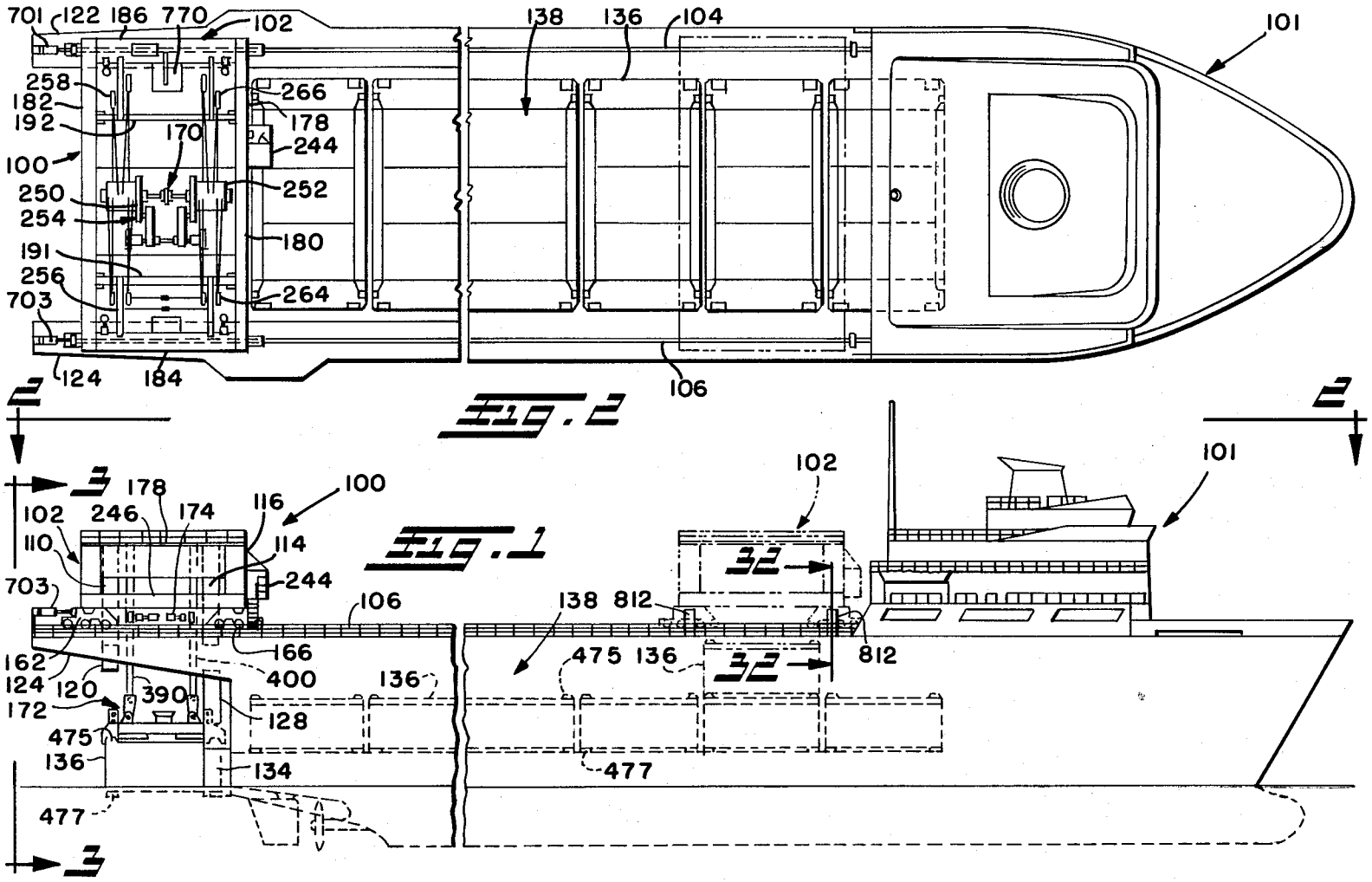
FIG. 1 is a fragmentary side elevational view of a lighter-carrying transport ship of the open stern wall type with a transport system embodying the present invention in a particular form mounted thereon, the crane of such transport system being illustrated in an operative position adapted for hoisting a lighter aboard, and also in phantom to illustrate a stowed position.
FIG. 2 is a fragmentary plan view of the ship of FIG. 1 taken along line 2—2 of FIG. 1.

Referring to the drawings and initially to FIGS. 1-5, the transport system of the present invention, which in its illustrated embodiment is indicated generally by the reference numeral 100, is mounted on a ship of the open stern wall type, which is indicated generally by the reference numeral 101 and comprises: a crane which is indicated generally by the reference numeral 102 and is adapted for travel along parallel spaced rails 104 and 106 which extend longitudinally along opposite sides of the deck of ship 101; vertically extendable and retractable load frame guide members 108, 110, 112 and 114 which depend from hoist support structure 116 of crane 102; removable guide members 118 and 120 which are removably mounted on parallel spaced cantilevered beams 122 and 124 which extend rearwardly from the stern of ship 101; removable guide members 126 and 128 which are removably mounted on stern 130 of ship 101; and fixed guide members 132 and 134 which are fixedly mounted on stern 130; the vertically extendable and retractable load frame guide members 108, 110, 112 and 114 along with the removable guide members 118, 120, 126 and 128 and the fixed guide members 132 and 134 being adapted for guiding the hoisting movement and restraining the swinging movement of cargo lighter 136 when such lighter is hoisted, all as hereinafter further explained.

Ship 101 is of the open stern wall type and, accordingly, is adapted for loading and unloading a first row or layer of cargo lighters 136 by floating such lighters through its open stern wall into and out of cargo hold 138. Ship 101 includes two coaxial hulls 140 and 142 and a plurality of ballast tanks spaced throughout the ship between hulls 140 and 142. The ballast tanks are used to partially submerge ship 101 or raise it to its floating position. Ship 101 is partially submerged by admitting water into the ballast tanks to provide a sufficient depth of water in cargo hold 138 to permit a single layer of lighters 136 to be floated into or out of cargo hold 138. When the loading or unloading of lighters 136 is completed, the ship is raised by evacuating watter from the ballast tanks sufficiently to raise the bottom of the cargo hold 138 preferably above the water line and thereby permit all or substantially all of the water in cargo hold 138 to drain out of the cargo hold through the open stern wall. Ship 101 includes a pair of parallel spaced cantilevered beams 122 and 124 which extend rearwardly from its stern. Beams 122 and 124 form a platform for crane 102 to travel to an outboard position over the stern of ship 101. Ship 101 is entirely conventional in design and construction and, accordingly, need not be further described herein.

Crane 102 includes hoist support structure 116 which has sufficient transverse dimension to span the width of cargo hold 138 and is supported by leg members 150, 152, 154 and 156 which in turn are mounted on traveling carriages 160, 162, 164 and 166, respectively. Carriages 160 and 164 are adapted for travel along rail 104, and carriages 162 and 166 are adapted for travel along rail 106. A hoist mechanism, which is indicated generally by the reference numeral 170 and is adapted for hoisting load frame 172, is mounted on hoist support structure 116. A drive mechanism which is indicated generally by the reference numeral 174 and is adapted for moving crane 102 fore and aft along rails 104 and 106 is also mounted on hoist support structure 116.

Figure 4:
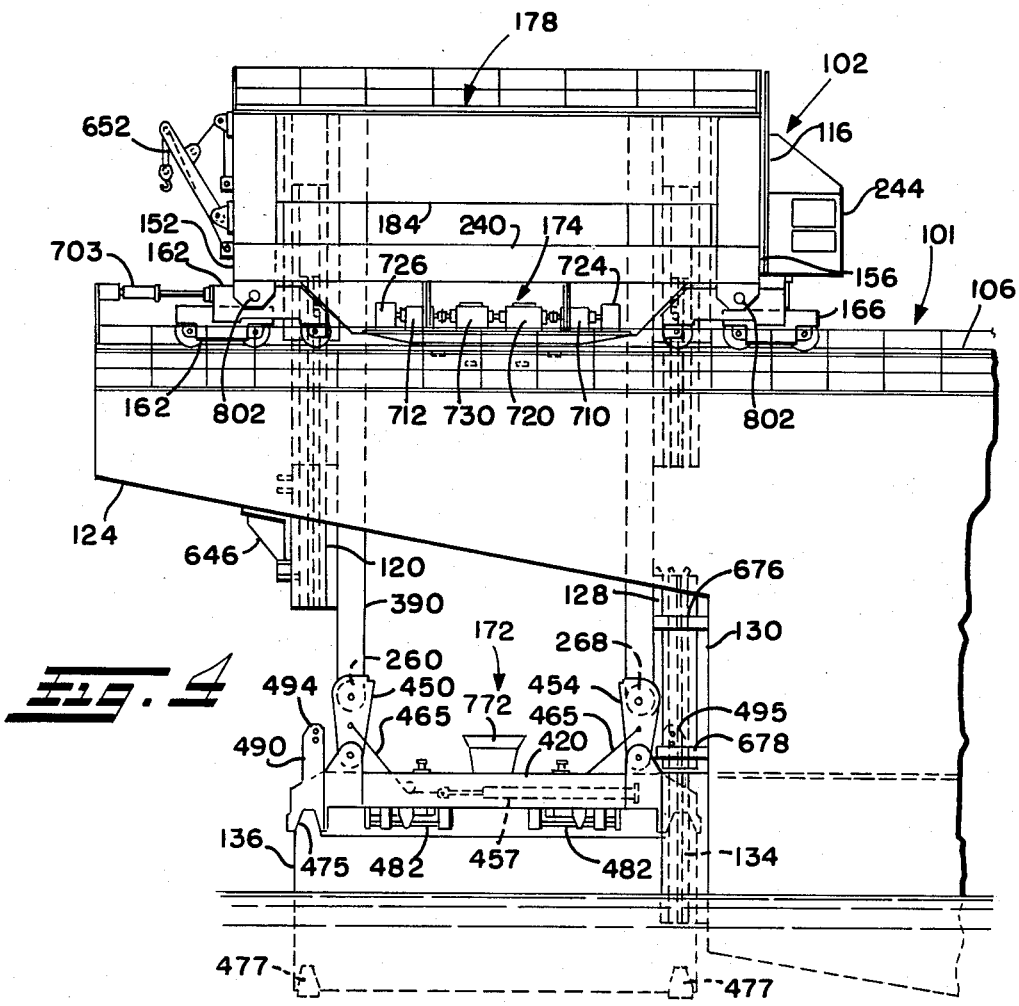
FIG. 4 is a fragmentary side elevational view taken along line 4—4 of FIG. 3.
Figure 8:
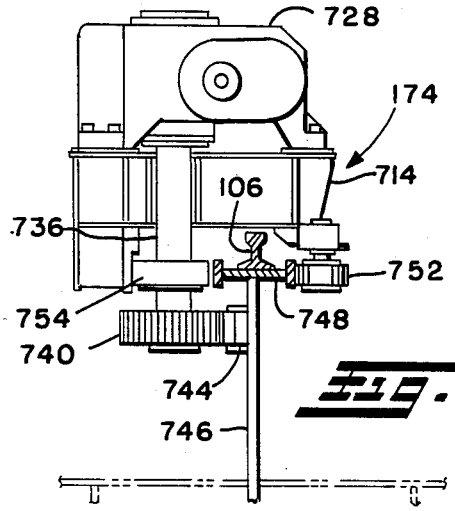
FIG. 8 is a sectional view taken along line 8—8 of FIG. 7.
Figure 9:
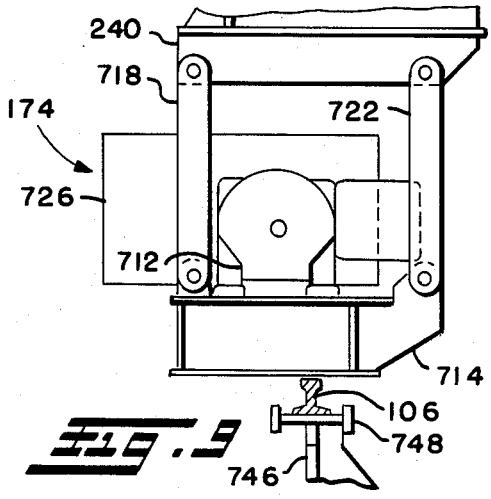
FIG. 9 is a sectional view taken along line 9—9 of FIG. 7.
Figure 5:
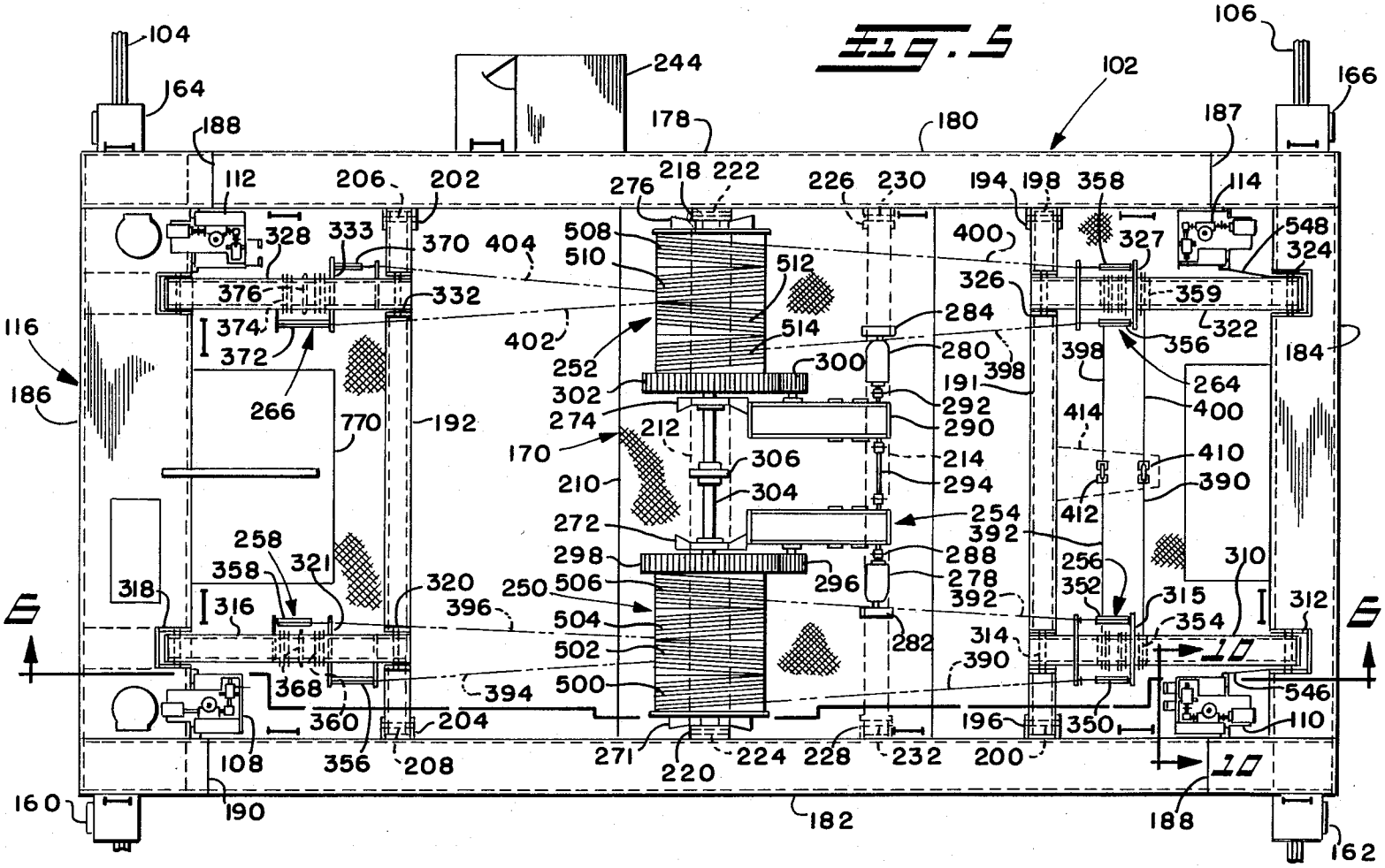
FIG. 5 is an enlarged top plan view of the crane of FIG. 1 taken along line 5—5 of FIG. 3.
Figure 5:
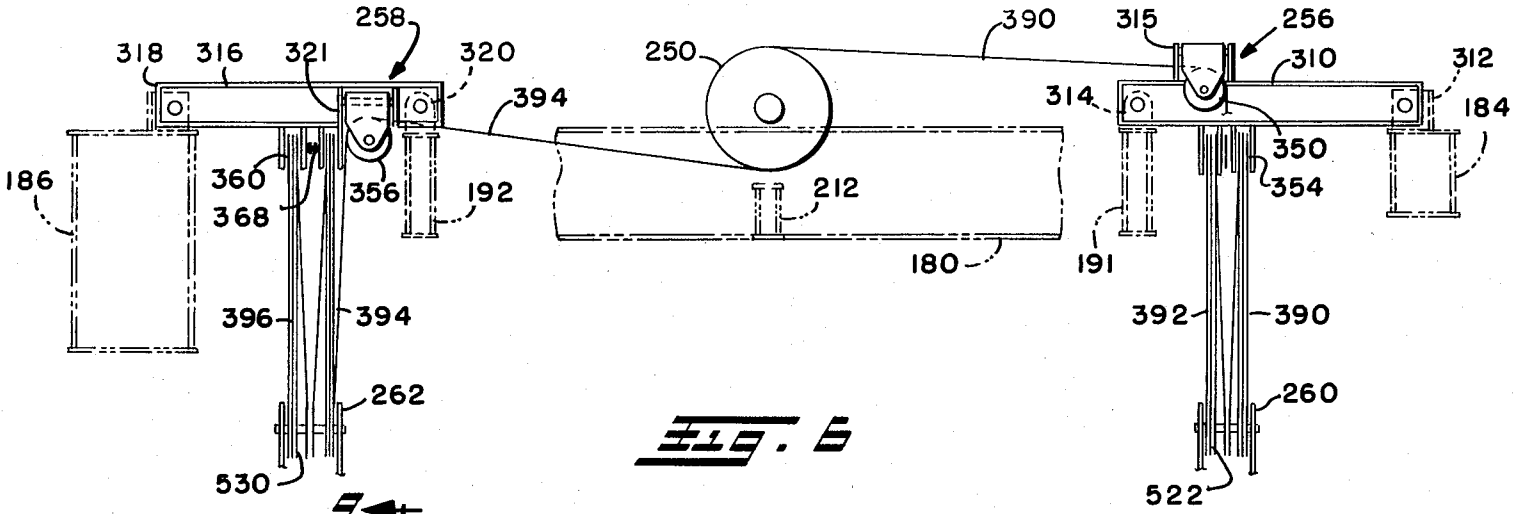
Figure 7:
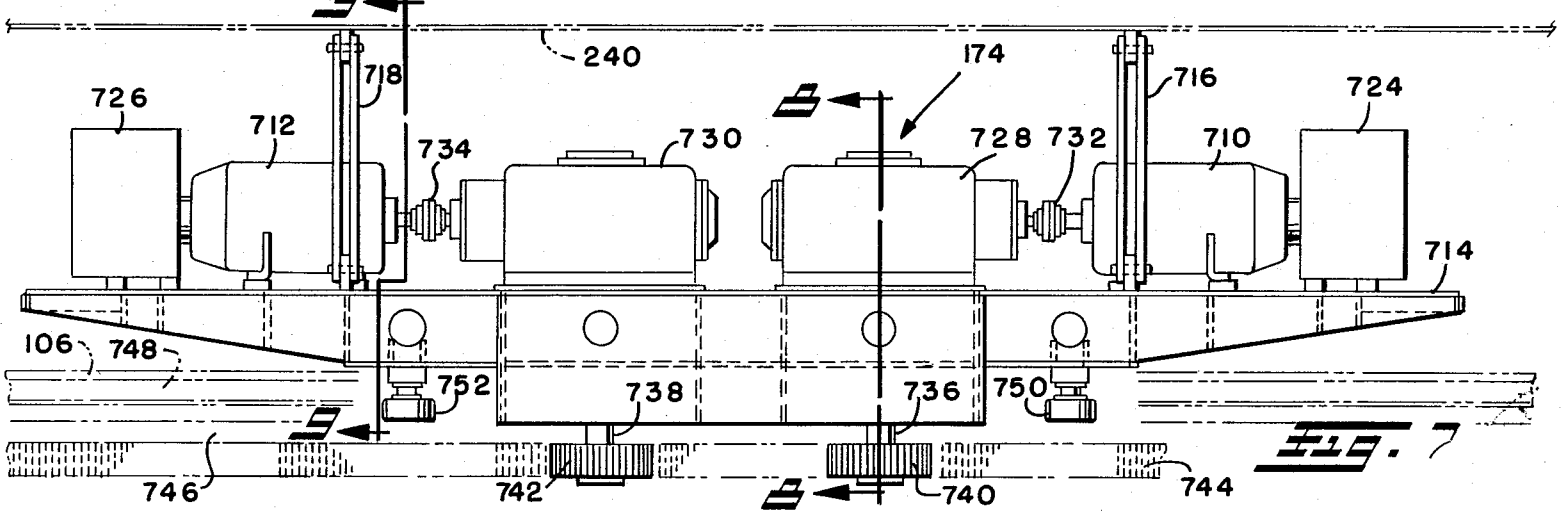
FIG. 7 is an enlarged fragmentary side elevational view taken along line 7—7 of FIG. 3 illustrating the drive mechanism for moving the crane of FIG. 1 fore and aft along spaced rails positioned on opposite sides of the deck of the ship of FIG. 1.
Figure 10:
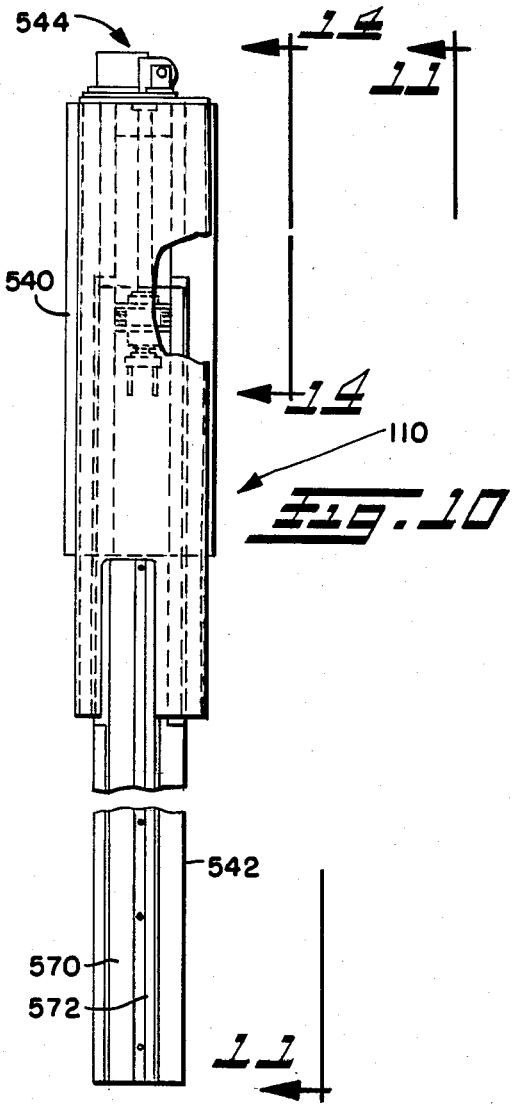
FIG. 10 is an enlarged fragmentary side elevation of one of the vertically extendable and retractable load frame guides of the transport system of FIG. 1 taken along line 10—10 of FIG. 5.
Figure 11:
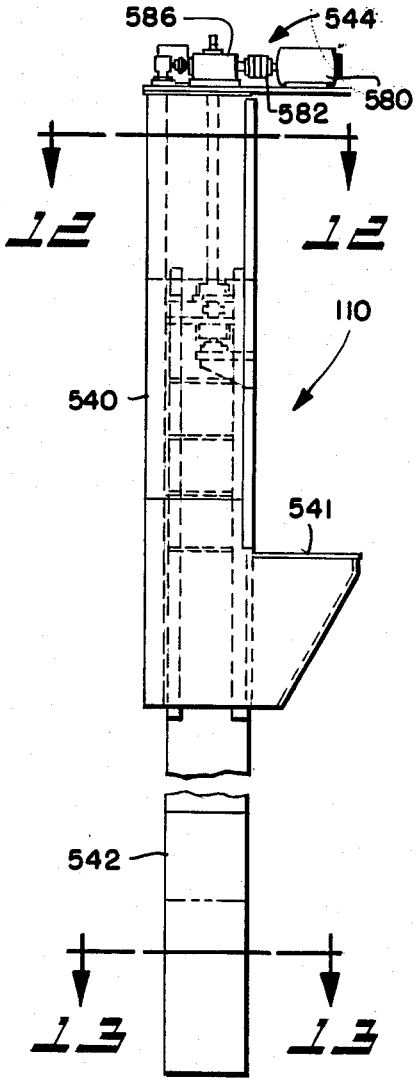
FIG. 11 is a side elevational view of the vertically extendable and retractable load frame guide of FIG. 10 taken along line 11—11 of FIG. 10.
Figure 12:
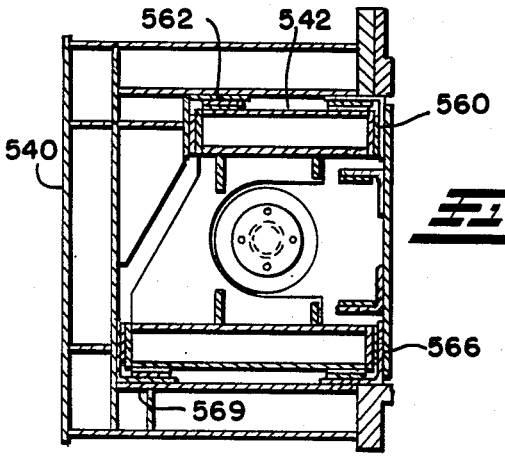
FIG. 12 is an enlarged cross-sectional view taken along line 12—12 of FIG. 11.
Figure 13:
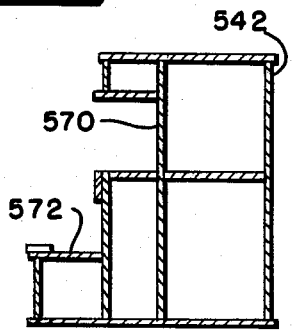
FIG. 13 is an enlarged cross-sectional view taken along line 13—13 of FIG. 11.

Hoist support structure 116 includes rectangular support frame 178 which is best illustrated in FIG. 5 and comprises a pair of parallel spaced girders 180 and 182 which are sufficiently elongated to span the width of cargo hold 138 and a pair of end girders 184 and 186 which extend longitudinally of ship 101 and are sufficiently elongated to provide a sufficient support base for hoist mechanism 170 and vertically extendable and retractable load frame guide members 108, 110, 112 and 114. Girders 180, 182, 184 and 186 are preferably made of plate and torsion box construction according to standard practice and formed of high tensile steel to provide maximum strength and minimum weight. Girder 184 is welded to girders 180 and 182 at splices 187 and 188, respectively. Similarly, girder 186 is welded to girders 180 and 182 at splices 189 and 190, respectively. Support frame 178 includes load girts 191 and 192 which are mounted on girders 180 and 182 and extend parallel to girders 184 and 186. Load girt 191 is secured to girders 180 and 182 by brackets 194 and 196 and pins 198 and 200, respectively. Bracket 194 is welded to girder 180 and bracket 196 is welded to girder 182. Similarly, load girt 192 is secured to girders 180 and 182 by brackets 202 and 204 and pins 206 and 208, respectively. Bracket 202 is welded to girder 180 and bracket 204 is welded to girder 182. Hoist support frame 178 also includes hoist machinery base 210 which is welded to support beams 212 and 214. Support beam 212 is secured to girders 180 and 182 by brackets 218 and 220 and pins 222 and 224, respectively. Brackets 218 and 220 are welded to girders 180 and 182, respectively. Support beam 214 is secured to girders 180 and 182 by brackets 226 and 228 and pins 230 and 232, respectively. Brackets 226 and 228 are welded to girders 180 and 182, respectively. Leg members 150 and 154 (FIGS. 1, 3 and 4) are welded to and project downwardly from girder 186. Similarly, leg members 152 and 156 are welded to and project downwardly from girder 184. Hoist support structure 118 also includes horizontally elongated sill 240 which is welded to and extends between leg members 152 and 156 and is positioned below and parallel to girder 184. Similarly, support structure 116 also includes another sill (not shown in the drawings) which is identical to sill 240 except that it is welded to and extends between leg members 150 and 154 and is positioned below and parallel to girder 186. Control cab 244 from which crane 102 is operated is welded to and depends from girder 180. The welds at splices 187, 188, 189 and 190 are preferably accomplished in the field. All other major welds can be accomplished prior to field assembly. No field welds are required for mounting the support elements for hoist mechanism 170 on support frame 178 since each of these elements are mounted on frame 178 with pin and mounting bracket assemblies. An advantage of the structure of crane 102, and particularly hoist support structure 116, is that with the exception of minor welds for support railings, guards, etc., crane 102 can be assembled with only four major field welds (i.e., at splices 187, 188, 189 and 190).

Hoist mechanism 170, which is best illustrated in FIGS. 1–6, includes a pair of lifting drums 250 and 252; a drive mechanism 254 for rotating lifting drums 250 and 252; a pair of upper sheave assemblies 256 and 258 and a pair of load frame sheave assemblies 260 and 262 associated with lifting drum 250; and a pair of upper sheave assemblies 264 and 266 and a pair of load frame sheave assemblies 268 and 270 associated with lifting drum 252. Lifting drums 250 and 252 are coaxially aligned with each other and mounted on pillow blocks 271 and 272, and 274 and 276, respectively. Pillow blocks 271, 272, 274 and 276 are welded to and project upwardly from hoist machinery base 210.

Drive assembly 214, which is best illustrated in FIG. 5, includes a pair of electric motors 278 and 280 which are mounted on hoist machinery base 216. Motors 278 and 280 are connected to electrically operated brake mechanisms 282 and 284, respectively. Brake mechanisms 282 and 284 are provided for reducing or stopping the rotation of lifting drums 250 and 252, respectively, and optionally locking such lifting drums in place during the transport of crane loads. Motor 278 is rotatably connected to gear reducer 286 with coupling 288. Similarly, motor 280 is rotatably connected to gear reducer 290 with coupling 292. Motors 278 and 280 are also interconnected by line shaft 294. The connection at line shaft 294 mechanically synchronizes motors 278 and 280 to insure that the rates of rotation of such motors are equal. Pinion gear 296 projects outwardly from reducer 286 and engages gear 298 which is mounted on the end of lifting drum 250. Similarly, pinion gear 300 projects outwardly from reducer 290 and engages gear 302 which is mounted on the end of lifting drum 252. Lifting drums 250 and 252 are interconnected by line shaft 304 which includes coupling 306. Line shaft 304 mechanically synchronizes the rotation rates of lifting drums 250 and 252.

Figure 2B:
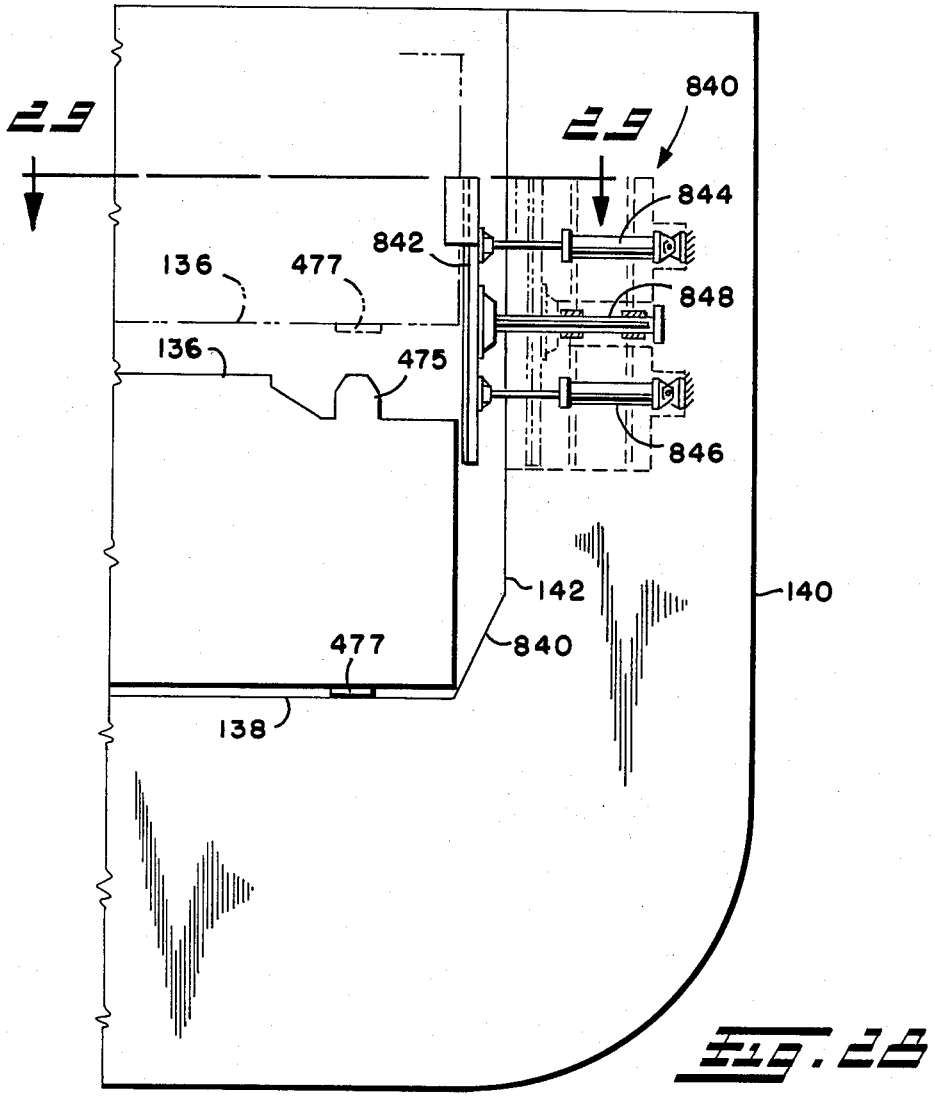
Figures 2, 3, 4, 5, 6, 7, 8, 9:
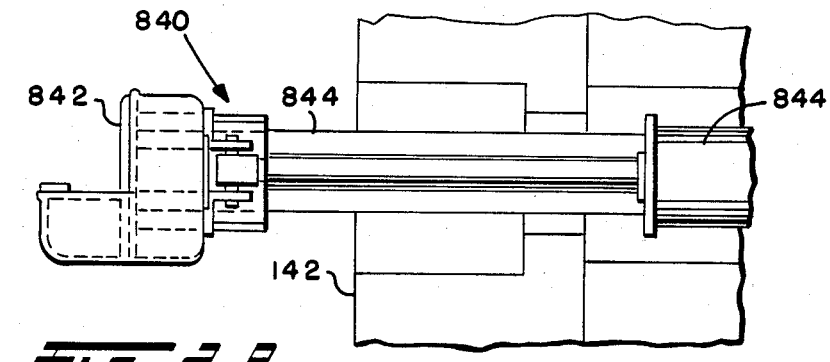
FIG. 6 is a fragmentary sectional view taken along line 6—6 of FIG. 5.

Upper sheave assembly 256, which is best illustrated in FIGS. 5 and 6, is mounted on support member 310 which in turn is mounted on girder 184 and load girt 191. Support member 310 is secured to girder 184 and load girt 191 by mounting brackets 312 and 314 which are welded to girder 184 and load girt 191, respectively, and include pins inserted through such brackets and support member 310. Sheave assembly 256 includes a mounting bracket 315 which is welded to support member 310, a pair of lead sheaves 350 and 352 which pivotally depend from bracket 315, and eight coaxial sheave wheels, which are indicated generally by the reference numeral 354 and are rotatably mounted on bracket 315 with their axes of rotation at a right angle to the axis of rotation of lifting drum 250.

Upper sheave assembly 264 is mounted on support member 322 which in turn is mounted on girder 184 and load girt 191. Support member 322 is secured to girder 184 and load girt 191 by brackets 324 and 326 which are welded to girder 184 and load girt 191, respectively, and include pins inserted through such brackets and support member 322. Upper sheave assembly 264 is identical in design and construction to sheave assembly 256 and includes a bracket 327 which is mounted on support member 322, a pair of lead sheaves 356 and 358 which pivotally depend from bracket 327 and eight coaxial sheave wheels, which are indicated generally by the reference numeral 359 and are rotatably mounted on bracket 327 with their axes of rotation at a right angle to the axis of rotation of lifting drum 252.

Upper sheave assembly 258 is mounted on support member 316 which in turn is mounted on girder 186 and load girt 192. Support member 316 is secured to girder 186 and load girt 192 by mounting brackets 318 and 320 which are welded to girder 186 and load girt 192, respectively, and include pins inserted through such brackets and support member 316. Upper sheave assembly 258 includes a mounting bracket 321 which is mounted on support member 316, a pair of lead sheaves 356 and 358 which pivotally depend from bracket 321, six sheave wheels, which are indicated generally by the reference numeral 360 and are coaxially mounted on bracket 321 with their axis of rotation at a right angle to the axis of rotation of lifting drum 250, and an equalizer bar 368 pivotally mounted on bracket 321 with its axis of rotation being coaxial to the axis of rotation of sheave wheels 360. Equalizer bar 368 is positioned in the middle of sheave wheels 360, i.e., three of the sheave wheels 360 are positioned on the port side of equalizer bar 368 and the other three sheave wheels 360 are positioned on the starboard side of equalizer bar 368.

Upper sheave assembly 266 is mounted on support member 328 which in turn is mounted on girder 186 and load girt 192. Support member 328 is secured to girder 186 and load girt 192 by brackets 330 and 332 which are welded to girder 186 and load girt 192, respectively, and include pins inserted through support member 328. Upper sheave assembly 266 is identical in design and construction to upper sheave assembly 258 and includes a bracket 333 which is mounted on support member 328, a pair of lead sheaves 370 and 372 which pivotally depend from bracket 333, six upper sheave wheels which are indicated generally by the reference numeral 374 and are coaxially mounted on bracket 333 with their axes of rotation at a right angle to the axis of rotation of lifting drum 252, and an equalizer bar 376 mounted on bracket 333 with its axis of rotation being coaxial to the axis of rotation of sheave wheels 374. Equalizer bar 376 is positioned in the middle of sheave wheels 374, i.e., three of the sheave wheels 374 are positioned on the starboard side of equalizer bar 376 and the other three sheave wheels 374 are positioned on the port side of equalizer bar 376.

Load frame 172, which is best illustrated in FIGS. 3, 4, 25 and 26, includes a starboard side load beam 420 and a port side load beam 422 which are linked together by parallel spaced tubular members 424 and 426 to form a rectangular structure. Tubular member 424 is attached to load beams 420 and 422 by pins 428 and 430 which are inserted through tubular member 424 and brackets 432 and 434, respectively. Brackets 432 and 434 are welded to load beams 420 and 422, respectively. Similarly, tubular member 426 is connected to load beams 420 and 422 by pins 436 and 438 which are inserted through mounting brackets 440 and 442, respectively. Brackets 440 and 442 are welded to load beams 420 and 422, respectively. Diagonal brace cables 444 and 446 are attached to and extend from the ends of tubular member 424 to the middle of tubular member 426 wherein they are attached. Cables 444 and 446 are employed to prevent collapse and twisting of the load frame 172. The pivotal connections between the load beams 420 and 422 and the tubular members 424 and 426 permit load beams 420 and 422 to move into and out of coplanar relationship with one another, and at the same time remain in vertical alignment with the ropefalls suspending load frame 172 when the lighter 136 to which the load frame 172 is attached is rocked in a plane perpendicular to load beams 420 and 422.

Each of the load frame sheave assemblies 260, 262, 268 and 270 is mounted on link members 450, 452, 454 and 456, respectively. Link members 450 and 454 are pivotally mounted on the aft and fore ends of load beam 420, respectively, and are adapted for pivotal movement about pins 480 and 482 in a vertical plane through the longitudinal center line of load beam 420. Similarly, link members 452 and 456 are pivotally mounted on the aft and fore ends of load beam 422, respectively, and are adapted for pivotal movement about pins (not shown in the drawings) which are identical to pins 480 and 482 in a vertical plane through the longitudinal center line of load beam 422. The links 450, 452, 454 and 456 and the tensioning mechanisms associated with each of such links serve to maintain tension in the ropefalls suspending load frame 172 when load frame 172 is latched to a floating lighter 136 that is tossed by sea swell such as during the hoisting of lighter 136, upwardly or downwardly from or to a floating position. The pivotable links 450, 452, 454 and 456 also accommodate rocking movement of the lighter 136 in a plane parallel to the longitudinal center line of the load beams 420 and 422.

Figure 26:
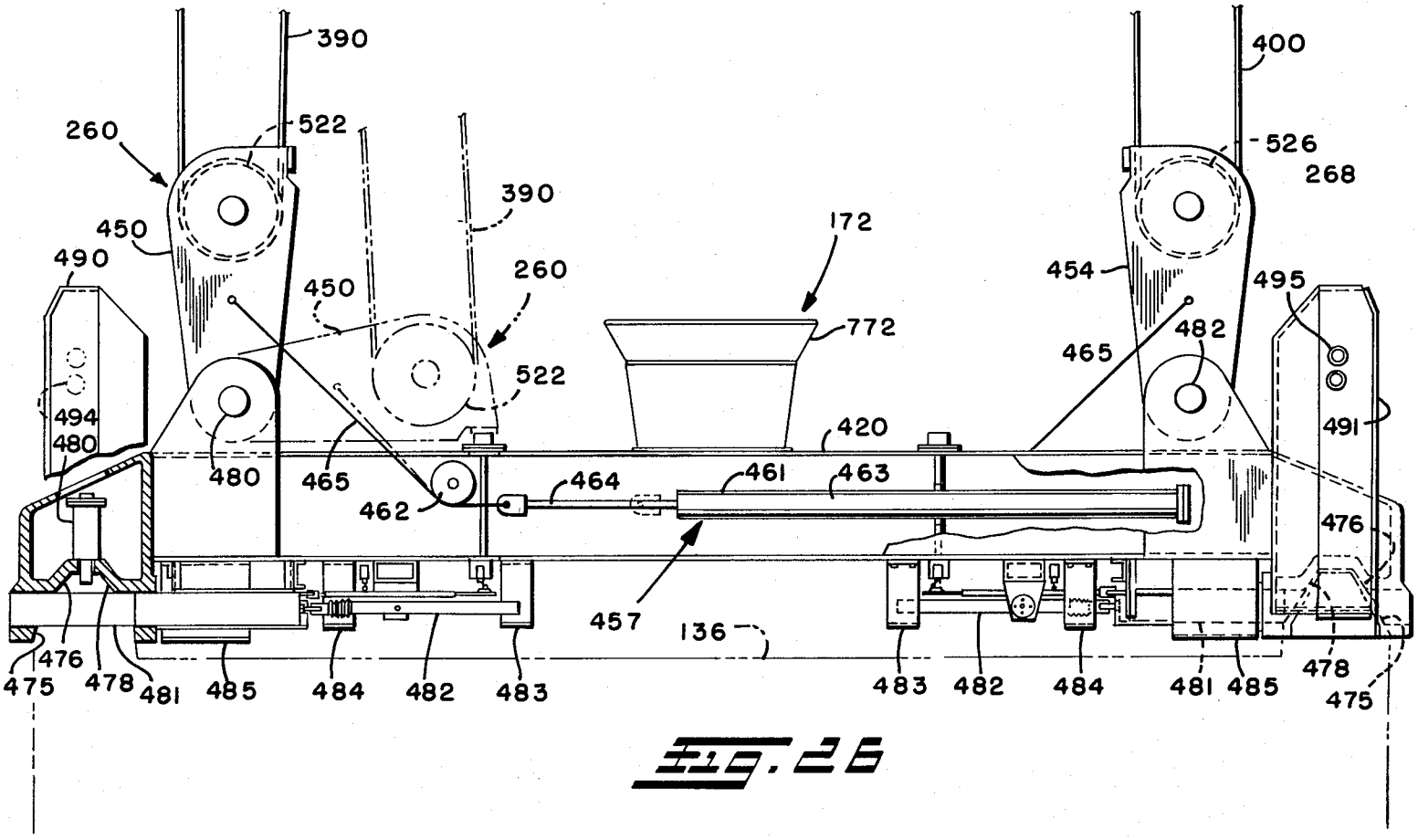
FIG. 26 is a fragmentary partially cross-sectioned side elevational view taken along line 26—26 of FIG. 25.

Pivotable links 450, 452, 454 and 456 are connected to tensioning mechanisms 457, 458, 459 and 460, respectively. Tensioning mechanisms 457 and 459 are mounted on load beam 420, while mechanisms 458 and 460 are mounted on load beam 422. Each of the tensioning mechanisms 457, 458, 459 and 460 are adapted for biasing their respective link toward its pivoted position (as illustrated in FIG. 26 in phantom with respect to link 450). The design and construction of each of the tensioning mechanisms is identical in design and construction. Accordingly, the following description of mechanism 457 is also applicable to tensioning mechanisms 458, 459 and 460. As best illustrated in FIG. 26, tensioning mechanism 457 includes a spring and plunger assembly 461, and a guide sheave 462, both of which are mounted on load beam 420. Spring and plunger assembly 461 includes tubular housing 463 for containing a pair of coaxial springs and plunger 464 which projects from housing 463 and is biased inwardly by the springs contained within housing 463. Cable 465 is attached at one end to link 450, at the other end to plunger 464 and is guided by sheave 462. The bias exerted by the springs contained within housing 463 on plunger 464 exerts a constant tension in cable 465 to bias link 450 from the upright position indicated by the solid lines in FIG. 26 towards the pivoted or collapsed position indicated in phantom in FIG. 26. Thus load frame sheave 260 is capable of vertical movement from the position indicated by the solid lines in FIG. 26 to the position indicated in phantom in FIG. 26 in order to maintain tension in the ropefalls 390 and 392 reeved through it when lighter 136 is tossed upwardly by sea swell.

Each of the load frame sheave assemblies 260, 262, 268 and 270 has eight coaxial sheave wheels which are indicated generally by the reference numerals 522, 530, 526 and 534, respectively. The axes of rotation of sheave wheels 522 and 526 are at right angles to the longitudinal center line of load beam 420 and parallel to the center line of pins 480 and 482, respectively. Similarly, the axes of rotation of sheave wheels 530 and 534 are at right angles to the longitudinal center line of load beam 422 and parallel to the center line of the pins securing links 452 and 456 to load beam 422.

Figure 3:
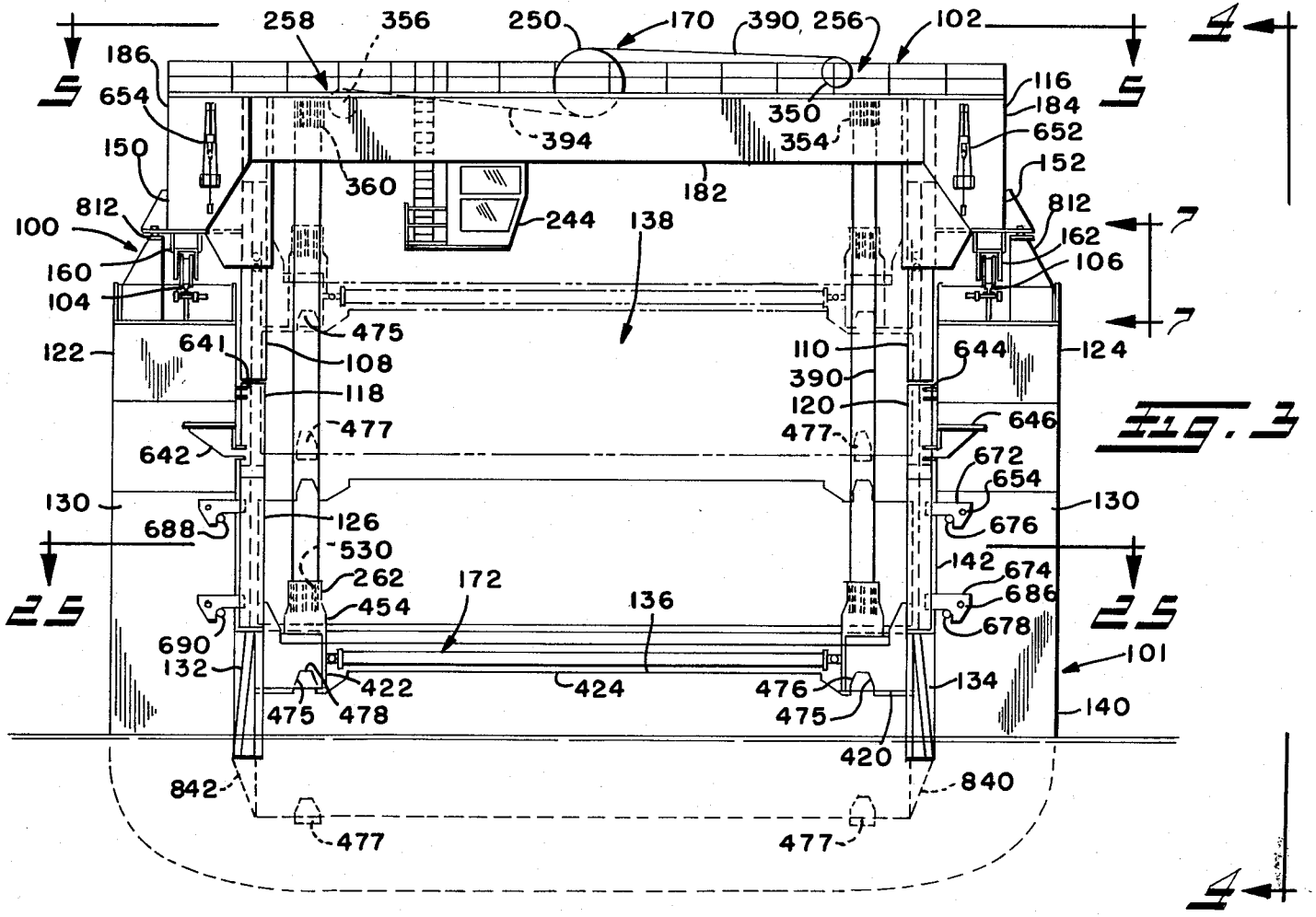
FIG. 3 is an enlarged end elevational view taken along line 3—3 of FIG. 1.

Referring to FIGS. 3, 4 and 26, each of the lighters 136 has four corner posts 475 on its top. Corner posts 475 have tapered tops 476 of pyramid-shape. Each lighter 136 also has four matching corner recesses 477 in its bottom. The corner posts 475 are of considerable strength and capable of supporting the weight of lighter 136 itself as well as one, two, or more additional lighters 136 stacked one above another as indicated in FIG. 1. Accordingly, lighters 136 stacked in a second or additional layers or rows above a first layer can be secured in place by means of corner posts 475 and matching recesses 477 whereby lateral movement of lighters 136 relative to one another is restrained, thus preventing shifting of the cargo lighters 136 in cargo hold 138. The load beams 420 and 422 of load frame 172 have a pair of pyramid shaped recesses 478 formed in their bottom surfaces, one of the recesses 478 being at the fore end of each of the load beams 420 and 422 and the other of such recesses 478 being at the aft end of each of the load beams 420 and 422. Each of the recesses 478 are adapted fo receiving one of the corner posts 475 of cargo lighter 136. The tapered configurations of corner posts 475 and recesses 478 assure accurate alignment of load frame 172 relative to lighters 136 and also permits the operator of crane 102 sufficient margin of error in dropping load frame 172 into position, the recesses 478 serving as a centering and locating means for load beam 172. When a corner post 475 is seated within its respective recess 478, the top of such post 475 forces spring-loaded plunger 479 upwardly to trip a limit switch contained within the shock absorber and limit switch assembly 480.

Each recess 478 has associated with it a latch mechanism that includes a horizontally elongated latch pin 481 which has a rectangular cross section and is adapted for insertion through a corresponding horizontal slot of rectangular cross section which is provided in each corner post 475. Each latch pin 481 is mounted on its associated load beam and is moved horizontally toward or away from its respective recess 478 by hydraulic drive mechanism 482. Each recess 478 has shock absorber and limit switch assembly 480 mounted over it. Spring loaded plunger 479 projects from assembly 480 into recess 479. Assembly 480 is operatively connected to drive mechanism 482. Hydraulic drive mechanism 482 is actuated by the limit switch contained within shock absorber and limit switch assembly 480. Because load frame 172 can be expected to be dropped frequently upon lighter 136 with considerable impact, hydraulic cylinder guards 483 and 484, and latch pin guard 485 are provided for protecting each of the hydraulic drive mechanisms 482 and latch pins 481. Load frame 172 is disengaged from lighter 136 by retracting each of the latch pins 481 from their respective corner posts 475. Latch pins 481 are retracted from corner posts 475 by activating drive mechanisms 482. Drive mechanisms 482 are activated by the crane operator stationed in control cab 244.

Referring to FIG. 5, lifting drum 250 has two sets of right-handed grooves, indicated generally by the reference numerals 500 and 504, and two sets of left-handed grooves, indicated generally by the reference numerals 502 and 506, formed on its surface. Right-handed grooves 500 and 504 are adapted for coiling and uncoiling ropefalls 390 and 396, respectively. Left-handed grooves 502 and 506 are adapted for coiling and uncoiling ropefalls 394 and 392, respectively. One end of each of the ropefalls 390, 392, 394 and 396 is secured to lifting drum 250 with a rope clamp assembly of conventional design (not shown in the drawings). Each of the ropefalls 390, 392, 394 and 396 is reeved as described below.

Lifting drum 252 has two sets of right-handed grooves, indicated generally by the reference numerals 510 and 514, and two sets of left-handed grooves, indicated generally by the reference numerals 508 and 512 formed on its surface. Right-handed grooves 510 and 514 are adapted for coiling and uncoiling ropefalls 404 and 398, respectively. Left-handed grooves 508 and 512 are adapted for coiling and uncoiling ropefalls 400 and 402, respectively. One end of each of the ropefalls 398, 400, 402 and 404 is secured to lifting drum 252 by a rope clamp assembly of conventional design (not shown in the drawings). Each of the ropefalls 398, 400, 402 and 404 is reeved as described below.

The reeving of ropefalls 390, 392, 394, 396, 398, 400, 402 and 404 is best illustrated in FIGS. 1–6. Ropefall 390, which is coiled and uncoiled in grooves 500 of lifting drum 250, extends from lifting drum 250 to lead sheave 350, wraps around lead sheave 350 and drops to load frame sheave assembly 260, wraps around the fourth innermost sheave wheel 522 from the starboard side of load frame sheave assembly 260, extends upwardly to upper sheave assembly 256, wraps around the fourth innermost sheave wheel 354 from the starboard side of sheave assembly 256, repeats the cycle three more times until it is reeved through the four sheave wheels 522 on the starboard side of the load frame sheave assembly 260 and the corresponding four sheave wheels 354 on the starboard side of upper sheave assembly 256, and then extends from upper sheave assembly 256 horizontally and forwardly and is attached to link plate 410. Link plate 410 is also attached to ropefall 400 and to a wire rope (not indicated in the drawings) which extends vertically downwardly from link plate 410 and is pivotally attached to support member 414. Support member 414 is welded to and extends horizontally from load girt 191. Ropefall 392, which is coiled and uncoiled in grooves 506 of lifting drum 250, extends from lifting drum 250 to lead sheave 352, wraps around lead sheave 352 and drops to load frame sheave assembly 260, wraps around the fourth innermost sheave wheel 522 from the port side of load frame sheave assembly 260, extends upwardly to upper sheave assembly 256, wraps around the fourth innermost sheave wheel 354 from the port side of sheave assembly 256, repeats the cycle three more times until it is reeved through the four sheave wheels 522 on the port side of load frame sheave assembly 260 and the corresponding four sheave wheels 354 on the port side of upper sheave assembly 256, then extends forwardly and horizontally and is attached to link plate 412. Link plate 412 is also attached to ropefall 398 and to a wire rope (not shown in the drawings) which extends vertically downwardly from link plate 412 and is pivotally attached to support member 414.

The reeving of ropefalls 400 and 398 is virtually identical to that of ropefalls 390 and 392, respectively. Ropefall 400, which is coiled and uncoiled in grooves 508 of lifting drum 252, extends from lifting drum 252 to lead sheave 358, wraps around lead sheave 358 and drops to load frame sheave assembly 268, wraps around the fourth innermost sheave wheels 526 from the starboard side of load frame sheave assembly 268, extends upwardly to upper sheave assembly 264, wraps around the fourth innermost sheave wheel 359 from the starboard side of upper sheave assembly 264, repeats the cycle three more times until the four sheave wheels 526 on the starboard side of the load frame sheave assembly 268 and the corresponding four sheave wheels 359 on the starboard side of upper sheave assembly 264 have been reeved, then extends horizontally and aft to link plate 410 wherein it is attached to link plate 410 and ropefall 390. Ropefall 398, which is coiled and uncoiled in grooves 514 of lifting drum 252, extends from lifting drum 252 to lead sheave 356, wraps around lead sheave 356 and drops to load frame sheave assembly 268, wraps around the fourth innermost sheave wheel 526 from the port side of load frame sheave assembly 268, extends upwardly to upper sheave assembly 264, wraps around the fourth innermost sheave wheel 359 from the port side of upper sheave assembly 264, repeats the cycle three more times until the four sheave wheels 526 on the port side of load frame sheave assembly 268 and the corresponding four sheave wheels 359 on the port side of upper sheave assembly 264 have been reeved, then extends horizontally and aft to link plate 412 wherein it is attached to link plate 412 and ropefall 312.

Ropefall 394, which is coiled and uncoiled in grooves 502 of lifting drum 250, extends from lifting drum 250 to lead sheave 356, wraps around lead sheave 356 and drops to load frame sheave assembly 262, wraps around the outermost sheave wheel 530 on the starboard side of load frame sheave assembly 262 (i.e., furthest starboard side sheave wheel 530 from the center of sheave assembly 262), extends upwardly to upper sheave assembly 258, wraps around the outermost sheave wheel 360 on the starboard side of upper sheave assembly 258 (i.e., furthest starboard side sheave wheel 360 from the center of sheave assembly 258), repeats the cycle two more times until ropefall 394 has been reeved through the three upper sheave wheels 360 on the starboard side of upper sheave assembly 258 and the three corresponding outermost starboard side sheave wheels 530 of load frame sheave assembly 262, then drops from upper sheave assembly 258 to the fourth innermost sheave wheel 530 on the starboard side of load frame sheave assembly 262, then extends upwardly to equalizer bar 368 wherein it is attached to one side of equalizer bar 368. Ropefall 396, which is coiled and uncoiled in grooves 504 of lifting drum 250, extends from lifting drum 250 to leave sheave 358, wraps around lead sheave 358 and drops to load frame sheave assembly 262, wraps around the outermost sheave wheel 530 on the port side of load frame sheave assembly 262, extends upwardly and wraps around the corresponding outermost port side sheave wheel 360 of upper sheave assembly 258, repeats the cycle two more times until ropefall 396 has been reeved through the three outermost wheels 530 on the port side of sheave assembly 262 and the three corresponding outermost wheels 360 on the port side of upper sheave assembly 258, then drops from upper sheave assembly 258 to the innermost sheave wheel 530 on the port side of sheave assembly, wraps around innermost port side wheel 530, and then extends upwardly to equalizer bar 368 wherein it is attached on the opposite side of ropefall 394.

The reeving of ropefalls 404 and 402 is virtually identical to the reeving of ropefalls 394 and 396, respectively. Ropefall 404, which is coiled and uncoiled in grooves 510 of lifting drum 252, extends from lifting drum 252 lead sheave 370, wraps around lead sheave 370 and drops to load frame sheave assembly 270, wraps around the outermost sheave wheel 534 on the starboard side of load frame sheave assembly 270, extends upwardly to and wraps around the corresponding outermost starboard side sheave wheel 374 of upper sheave assembly 266, repeats the cycle two more times until ropefall 404 has been reeved through the three sheave wheels 374 on the starboard side of upper sheave assembly 266 and the three corresponding outermost starboard side sheave wheels 534 of load frame sheave assembly 270, then drops from upper sheave assembly 270 to the fourth innermost sheave wheel 534 on the starboard side of load frame sheave assembly, wraps around said innermost starboard side sheave wheel 534, and then extends upwardly to equalizer bar 376 wherein it is attached. Ropefall 402, which is coiled and uncoiled in grooves 512 of lifting drum 252, extends from lifting drum 252 to and wraps around lead sheave 372, drops to load frame sheave assembly 270, wraps around the outermost sheave wheel 534 on the port side of load frame sheave assembly 270, extends upwardly to upper sheave assembly 266, wraps around the corresponding outermost port side sheave wheel 374 of upper sheave assembly 266, repeats the cycle two more times until ropefall 402 has been reeved through the three sheave wheels 374 on the port side of sheave assembly 266 and the three corresponding outermost port side wheels 534 of load frame sheave assembly 270, then drops from upper sheave assembly 270 to and wraps around the innermost port side sheave wheel 534, and then extends upwardly to and is attached to equalizer bar 376.

Figure 25:
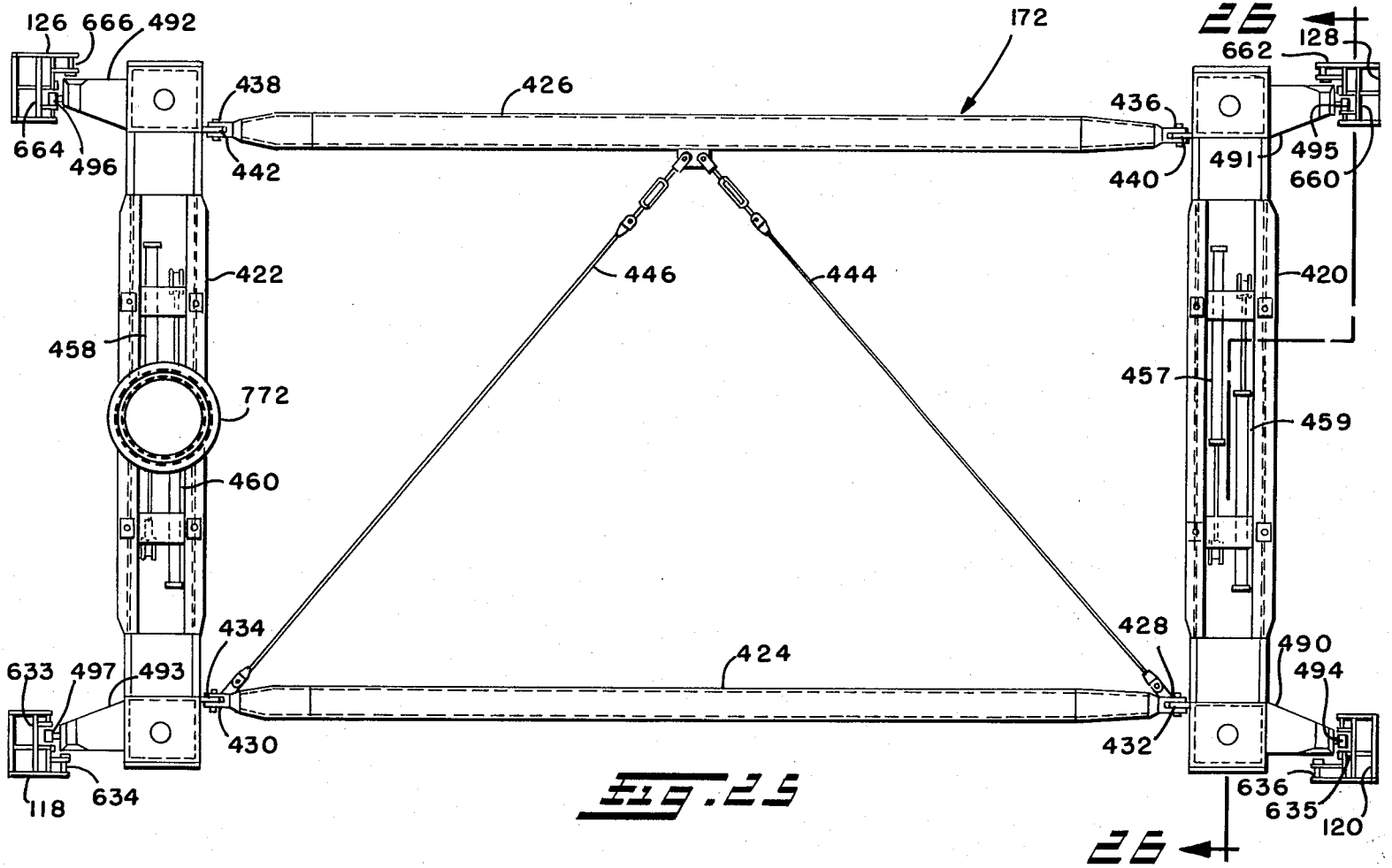
FIG. 25 is a sectional view taken along line 25—25 of FIG. 3 illustrating a plan view of the load frame of the transport system of FIG. 1.

Load frame 172 includes corner guide members 490, 491, 492 and 493 which extend outwardly and upwardly, as best illustrated in FIGS. 25 and 26, from each of its corners, and guide roller assemblies 494, 495, 496 and 497 which are mounted on each of said corner guide members 490, 491, 492 and 493, respectively. Corner guide 490 and guide roller assembly 494 are adapted for engaging vertically extendable and retractable guide member 110 and removable guide member 120 during the hoisting of load frame 172. Corner guide member 491 and guide roller assembly 495 are adapted for engaging vertically extendable and retractable guide member 114, removable guide member 128 and fixed guide member 134 during the hoisting of load frame 172. Corner guide 492 and guide roller assembly 496 are adapted for engaging vertically extendable and retractable guide member 112, removable guide member 126 and fixed guide member 132 during the hoisting of load frame 172. Corner guide member 493 and guide roller assembly 497 are adapted for engaging vertically extendable and retractable guide member 108 and removable guide member 118 during the hoisting of load frame 172.

Vertically extendable and retractable load frame guide members 108, 110, 112 and 114 are mounted on and project below hoist support frame 178 and are adapted for engaging the corners of load frame 172 to guide the hoisting movements and restrain the swinging movements of load frame 172. As best illustrated in FIG. 5, each of the vertically extendable and retractable guide members 108, 110, 112 and 114 are mounted on the corners of the hoist support frame 178. In this regard, guide 108 is mounted port side of frame 178 near the aft end. Guide 110 is mounted on the starboard side near the aft end. Guide 112 is mounted on the port side near the fore end, and guide 114 is mounted on the starboard side of frame 178 near the fore end. Each of the guide members 108, 110, 112 and 114 is identical in design and construction and, accordingly, the following description of vertically extendable and retractable guide member 110 is also applicable to vertically extendable and retractable guide members 108, 112 and 114. Guide member 110, which is best illustrated in FIGS. 10–14, includes a guide frame 540 which is mounted on and depends from hoist support frame 178, a guide member 542 which is telescopically received within guide frame 540 and extends downwardly from guide frame 540, and a drive mechanism, which is indicated generally by the reference numeral 544, for extending guide member 542 downwardly and retracting guide member 542 upwardly relative to guide frame 540.

Referring initially to FIG. 5, the guide frames 540 of guide mechanisms 108 and 112 are bolted to the inward (or starboard side) facing of girder 186. Support brackets 541 which extend outwardly from guide frames 540 are bolted to the sill that is provided as part of support structure 116 under girder 186. The guide frames 540 of guide mechanisms 110 and 114 are bolted to the inner (or port side) facing of guide column spacers 546 and 548, respectively, which in turn are welded to the inner facing of girder 184. Support brackets 541 are bolted to sill 240. Referring now to FIGS. 10–14, guide frame 540 is a vertically elongated structural member of plate and torsion box construction with a substantially rectangular cross-section that is adapted for supporting drive mechanism 544 and for supporting and telescopically receiving guide member 542. Guide frame 540 includes vertically elongated internal wear bars 560, 562, 564 and 566 (FIG. 12), and a pair of parallel spaced internal vertically elongated channel members 568 for receiving a corresponding pair of roller members 610 (FIG. 14), only one of said channel members 568 and roller members 610 being shown in the drawings. Wear bars 560, 562, 564 and 566 along with channel members 568 and roller members 610 are provided for guiding the telescoping movement of guide member 542 within guide frame 540. Guide member 542 includes a vertically elongated channel member 570 (FIGS. 10 and 13) which is adapted for receiving roller assembly 494 of load frame 172 and a vertically elongated guide bar 572 for engaging and guiding corner guide member 490 of load frame 172. Guide member 542 is extended downwardly and retracted upwardly within guide frame 540 by drive mechanism 544.

Figure 14:
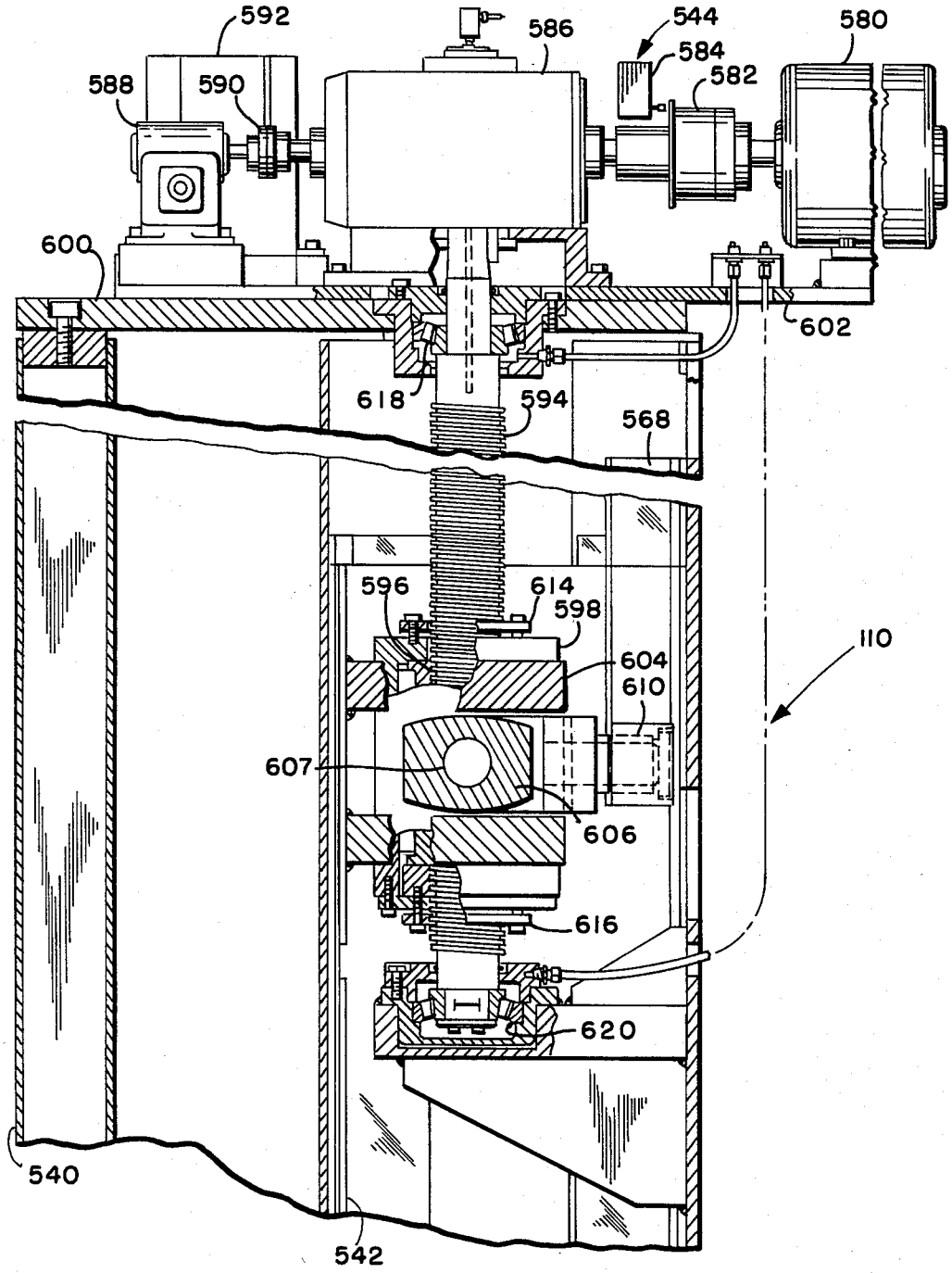
FIG. 14 is an enlarged fragmentary cross-sectional view taken along line 14—14 of FIG. 10 illustrating the drive mechanism for extending and retracting the guide illustrated in FIG. 10.

Drive mechanism 544, which is best illustrated in FIG. 14, includes electric motor 580 which is rotatably attached to slip clutch 582 which is of the torque limiter coupling type and which is activated by limit switch 584. Clutch 582 is rotatably attached to right angle worm gear reducer 586. Gear reducer 586 is attached to gear reducer 588 through coupling 590. Gear reducer 588 is a right angle worm gear which is rotatably attached to limit switch 592. Gear reducer 586 is rotatably attached to screw shaft 594 which can be rotated clockwise or counterclockwise and is adapted for driving internally threaded, non-rotatable axially movable nut 596 upwardly or downwardly. Motor 580, gear reducers 586 and 588 and limit switch 592 are mounted on cover plates 600 and 602 which in turn are mounted on guide frame 540. Nut 596 is housed within trunnion mounted nut housing 598 which is mounted on bracket 604. Bracket 604 is welded to the interior of guide member 542. A pair of wear bars 606 (only one of which is shown in the drawings) are mounted on trunnion sections 607 which project horizontally outwardly in diametrically opposed directions from housing 598. Wear bars 606 are provided for prohibiting or reducing binding between screw 594 and nut 596. Roller members 610 project horizontally outwardly from housing 598 and are received in channel members 568. Housing 598 also includes threaded retainer 614 and end plate 616. Tapered roller bearings 618 and 620 are provided at the top and bottom of screw shaft 594. Each of the guide members 108, 110, 112 and 114 are massive structures weighing, for example, about 23,000 pounds each when adapted for use with a 510 ton crane. Typical dimensions for such guides include, for example, heights of about 33 feet when fully extended, and a vertical travel for guide member 542 of, for example, about five feet.

Removable guide members 118 and 120, which are best illustrated in FIGS. 3, 4, 18–20, 25 and 27, are identical in design and construction with the exception that guide member 118 is adapted for mounting on the port side of ship 101 while guide member 120 is adapted for mounting on the starboard side of ship 101. Accordingly, the following description of guide member 120 is also applicable to guide member 118. Guide member 120 is a vertically elongated girder that includes vertically elongated channel member 635 which is adapted for receiving guide roller assembly 494 of load frame 172, and vertically elongated guide bar 636 which is adapted for contacting and guiding corner guide member 490 of load frame 172 (see FIGS. 25 and 27). Guide 118 includes channel member 633, which is identical in design and construction to channel member 635 of guide 120 and is adapted for receiving guide roller assembly 497 of load frame 172, and guide bar 634 which is identical in design and construction to guide bar 636 and is adapted for contacting and guiding corner guide member 493, (see FIG. 25). Guide 120 includes vertically elongated wear bars 637 and 638 which are adapted for contacting corner guide member 490 of load frame 172 and reducing the wear on guide 120. Guide 120 has a pair of mounting brackets 639 and 640 which are adapted for attachment to mounting brackets 644 and 646, respectively. Brackets 644 and 646 are welded to and project inwardly from cantilevered beam 124. Guide 118 has a pair of mounting brackets identical to mounting brackets 639 and 640 which are adapted for attachment to brackets 641 and 642 which are welded to and project inwardly from cantilevered beam 122. Mounting brackets 639 and 640 include apertures 647 and 648, and 649 and 650, respectively, which are adapted for receiving vertically oriented pins for securing guide 120 to mounting brackets 644 and 646. Guide 120 can be facilitatingly installed on brackets 644 and 646 or removed from brackets 644 and 646 by installing or removing such vertical pins. Jib crane 652 which is mounted on the aft side of leg member 152 is provided for hoisting guide member 120 into and out of its installed position on brackets 644 and 646. Similarly, jib crane 654 which is mounted on the aft side of leg member 150 is provided for hoisting removable guide 118 into and out of its installed position on mounting brackets 641 and 642. Each of the removable guides 118 and 120 is a massive structure weighing, for example, about 5200 pounds when adapted for use with a 510 ton crane. Typical dimensions for such guides include an overall height of, for example, about eleven and one-half feet.

Figure 15:
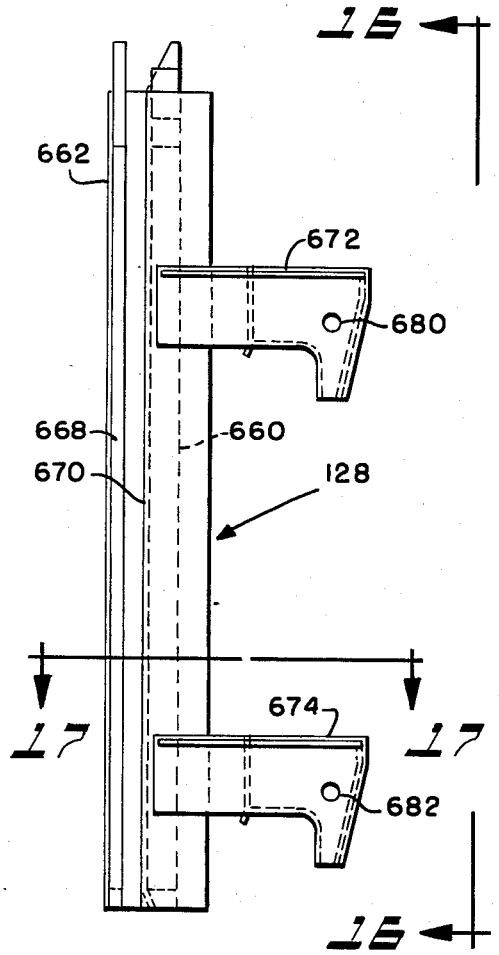
FIG. 15 is an enlarged side elevational view of one of the fore removable guides of the transport system of FIG. 1.
Figure 16:
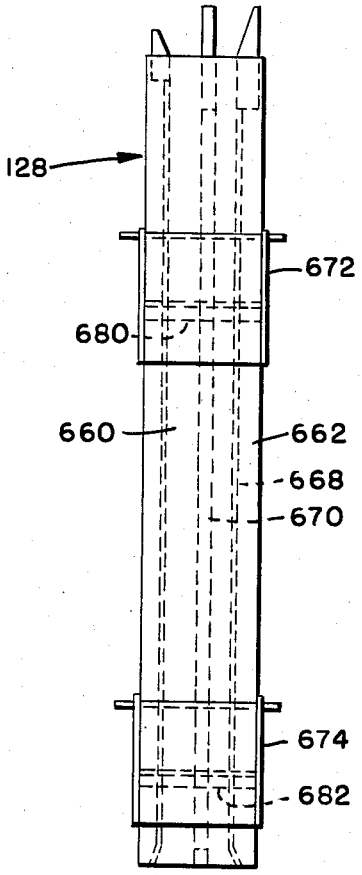
FIG. 16 is a side elevational view of the removable guide of FIG. 15 taken along line 16—16 of FIG. 15.
Figure 17:
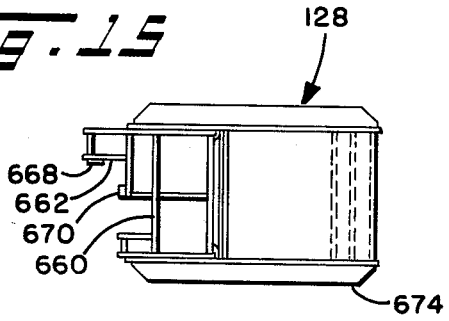
FIG. 17 is a sectional view of the removable guide of FIG. 15 taken along line 17—17 of FIG. 15.
Figure 17:
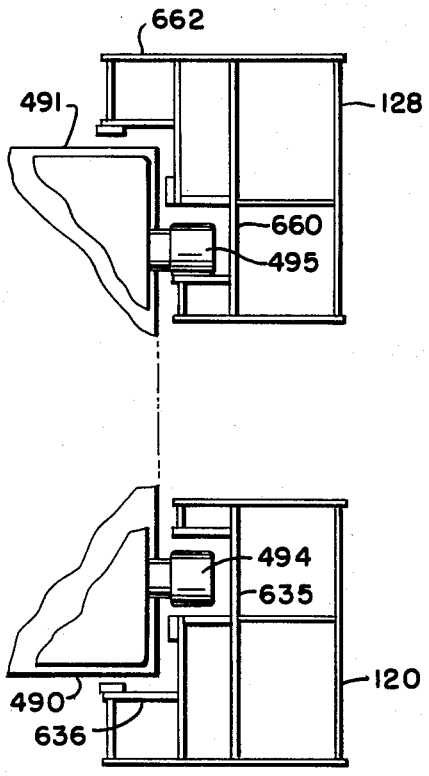
Figure 18:
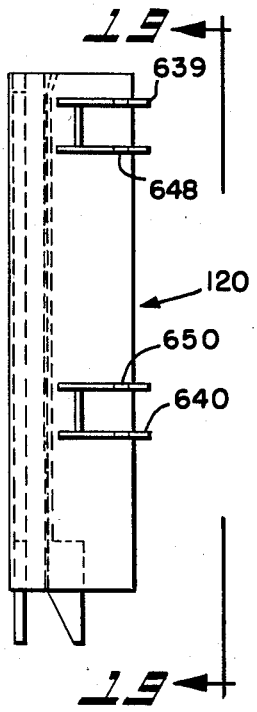
FIG. 18 is a side elevational view of one of the aft removable guides of the transport system of FIG. 1.
Figure 20:
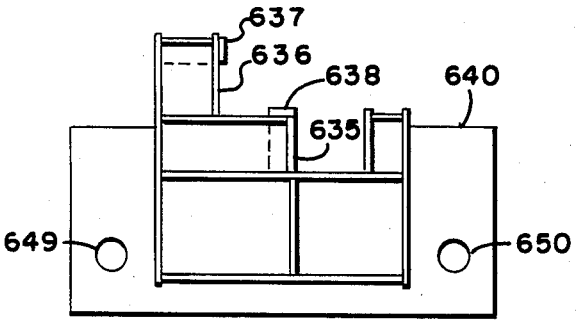
FIG. 20 is a sectional view of the guide of FIG. 18 taken along line 20—20 of FIG. 19.
Figure 19:
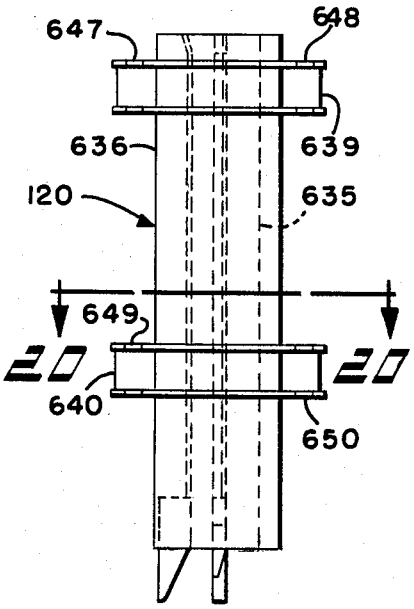
FIG. 19 is a side elevational view of the guide of FIG. 18 taken along line 19—19 of FIG. 18.
Figure 21:
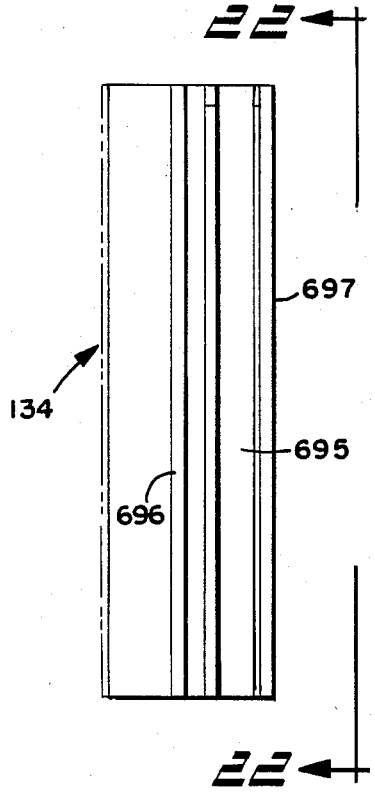
FIG. 21 is a side elevational view of one of the fixed guides of the transport system of FIG. 1.
Figure 22:
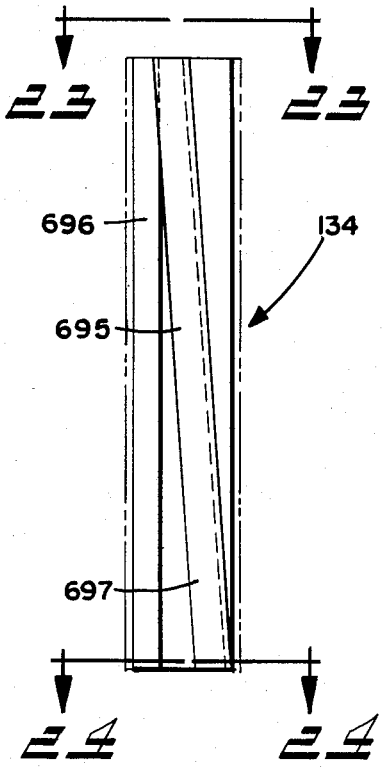
FIG. 22 is a side elevational view of the fixed guide of FIG. 21 taken along line 22—22 of FIG. 21.
Figure 23:
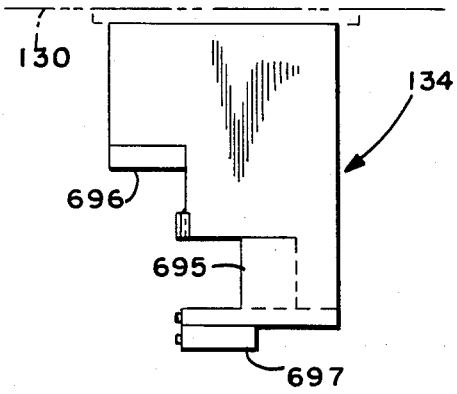
FIG. 23 is a sectional view taken along line 23—23 of FIG. 22.
Figure 24:
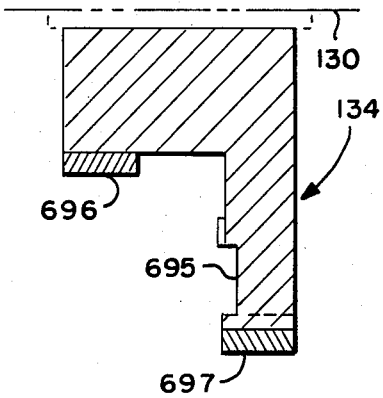
FIG. 24 is a sectional view taken along line 24—24 of FIG. 22.

Removable guide members 126 and 128, which are best illustrated in FIGS. 3, 4, 15–17, 25 and 27, are identical in design and construction with the exception that guide member 126 is adapted for mounting on the port side of ship 101 while guide member 128 is adapted for mounting on the starboard side of ship 101. Accordingly, the following description of guide member 128 is also applicable to guide member 126. Guide member 128, which is best illustrated in FIGS. 15–17, is a vertically elongated girder that includes vertically elongated channel member 660 which is adapted for receiving guide roller assembly 495 of load frame 172, and vertically elongated guide bar 662 which is adapted for engaging and guiding corner guide member 491 of load frame 172, (see FIG. 25). Guide 126 includes channel member 664, which is identical in design and construction to channel member 660, and is adapted for receiving guide roller assembly 496 of load frame 172, and guide bar 666 which is identical in design and construction to guide bar 662, and is adapted for contacting and guiding corner guide member 492. Guide 128 includes vertically elongated wear bars 668 and 670 which are adapted for contacting corner guide member 491 of load frame 172 and reducing the wear on guide 128. Guide 128 has a pair of mounting brackets 672 and 674 which are adapted for attachment to brackets 676 and 678 (FIGS. 3 and 4) which are welded to and project horizontally outwardly from the stern wall 130 of ship 101. Mounting brackets 672 and 674 include apertures 680 and 682 which are adapted for receiving horizontally oriented pins 684 and 686, respectively. Guide 128 can be facilitatingly installed on mounting brackets 676 and 678 or removed from brackets 676 and 678 by installing or removing pins 684 and 686. Jib crane 652 is provided for hoisting guide member 128 into and out of its installed position on brackets 676 and 678. Similarly, jib crane 654 is provided for hoisting removable guide 126 into and out of its installed position on mounting brackets 688 and 690. Each of the removable guides 126 and 128 is a massive structure weighing, for example, about 8300 pounds when adapted for use with a 510 ton crane. Typical dimensions for such guides include an overall height of, for example, about sixteen and one-half feet.

Fixed guide members 132 and 134, which are best illustrated in FIGS. 3, 4 and 21–24, are identical in design and construction with the exception that guide member 132 is adapted for mounting on the port side of ship 101 while guide member 134 is adapted for mounting on the starboard side of ship 101. Accordingly, the following description of guide member 134 is also applicable to guide member 132. Guide member 134 is a vertically elongated girder that includes a vertically elongated tapered channel member 695 which is adapted for receiving guide roller assembly 495 of load frame 172. The taper in channel member 695, which for a 510 ton crane can be about 4°, is provided for accommodating tilting or rocking movements of lighter 136 due to sea swell. Guide 134 also includes vertically elongated bumper members 696 and 697 which are preferably formed of solid rubber and are provided for contacting the starboard side forward corner of lighter 136. Guide members 132 and 134 are welded to the stern wall 130 of ship 101 and are adapted for vertical end-to-end alignment with removable guide members 126 and 128, respectively, when guide members 126 and 128 are in their installed position. For a 510 ton crane, guides 132 and 134 may have an overall height of, for example, about twelve feet and a weight of about 6700 pounds each.

Cantilevered beams 122 and 124, which are best illustrated in FIGS. 1–4, provide a platform for crane 102 to travel to an outboard position over the stern of ship 101. Bumper stops 701 and 703 are mounted on the ends of beams 122 and 124, respectively, and are adapted for preventing crane 102 from sliding off the end of ship 101 and for positioning crane 102 over the cargo lighters 136 to be hoisted. Extendable and retractable guides 108, 110, 112 and 114, removable guides 118, 120, 126 and 128, and fixed guides 132 and 134 are adapted to guide the hoisting movement and restrain the swinging movement of load frame 172 and cargo lighter 136. In operation, crane 102 is positioned for hoisting load frame 172 and cargo lighter 136 against bumper stops 701 and 703 so that extendable and retractable guides 108, 110, 112 and 114, removable guides 118, 120, 126 and 128, and fixed guides 132 and 134 are aligned. Extendable and retractable guide 108 is thus positioned over removable guide 118 in such a manner so that the respective guide channels and guide bars of each for receiving guide roller assembly 497 and engaging corner guide member 493 of load frame 172 are coaxially aligned. Similarly, extendable and retractable guide 110 is positioned over removable guide 120 in such a manner so that the respective guide channels and guide bars of each for receiving guiding roller assembly 494 and engaging corner guide member 490 are coaxially aligned. A clearance for a 510 ton crane of, for example, about three inches can be provided between the bottom section of guides 108 and 110 and the top sections of guides 118 and 120, respectively, when guides 108 and 110 are fully extended downwardly. Sufficient clearance under removable guides 118 and 120 is required to permit lighters 136 to float under such guides into the loading well defined by the area below cantilevered beams 122 and 124. Extendable and retractable guide 112, removable guide 126 and fixed guide 132 are positioned one above the other in such a manner so that the respective guide channels and guide bars of each for receiving guide roller assembly 496 and engaging corner guide member 492 of load frame 172 are coaxially aligned. Similarly, extendable and retractable guide 114, removable guide 128 and fixed guide 134 are positioned one above the other in such a manner so that the respective guide channels and guide bars of guide for receiving guide roller assembly 495 and engaging corner guide member 491 are coaxially aligned. A suitable clearance of, for example, about one inch can be provided between removable guides 126 and 128, and fixed guides 132 and 134, respectively. A suitable gap between the fully extended position of vertically extendable and retractable guides 112 and 114, and removable guides 126 and 128, respectively, to permit the movement of load frame 172 and cargo lighter 136 forward into cargo hold 138 after load frame 172 and cargo lighter 136 have been hoisted by crane 102 is necessary. For example, a suitable gap between the fully extended positions of guides 112 and 114, and removable guides 126 and 128, can be about seven and one-half feet for a 510 ton crane adapted for hoisting cargo lighters 138 with a height of about fourteen and one-half feet.

Drive mechanism 174, which as indicated above is provided for moving crane 102 fore and aft along rails 104 and 106, is best illustrated in FIGS. 4, 7, 8 and 9. Drive assembly 174, which is mounted on the starboard side of crane 102, is positioned between leg members 152 and 156 and below sill 240. Drive mechanism 174 includes electric motors 710 and 712 which are mounted on drive machinery base 714. Machinery base 714 is suspended from sill 240 by link members 716, 718, 720 and 722 (link member 720 not being shown in the drawings). Link members 716, 718, 720 and 722 pivotally depend from sill 240 and are pivotally connected to machinery base 714 to provide a parallelogram support for drive mechanism 174 that relieves drive mechanism 174 of all lateral loads experienced by crane 102 and carried by carriages 160, 162, 164 and 166. Motors 710 and 712 are operatively connected to electrically operated brake mechanisms 724 and 726, respectively. Brake mechanisms 724 and 726 are mounted on machinery base 714 and are employed for providing braking for drive mechanism 174 when desired to provide a positive lock to fix crane 102 at a desired position on rails 104 and 106 and to prevent crane 102 from rolling or sliding on rails 104 and 106 under varying conditions of longitudinal trim. Motors 710 and 712 are operatively connected to gear reducers 728 and 730 through couplings 732 and 734, respectively. Drive shafts 736 and 738 depend from and project vertically downwardly from gear reducers 728 and 730, respectively. Pinion gears 740 and 742 are mounted on the ends of drive shafts 736 and 738, respectively. Pinion gears 740 and 742 engage rack 744 which is mounted on the starboard side of support member 746 and extends longitudinally along the length of rail 106 below and parallel to rail 106. Rail 106 is supported by "I" beam 748 which is mounted on support member 746 and extends longitudinally along the length of rail 106. Guide rollers 750 and 752 depend from drive machinery base 714 and engage the port side of "I" beam 748. Similarly, guide rollers 754 and 756 (756 not being shown in the drawings) are mounted on drive shaft 736 and 738, respectively, and engage the starboard side of "I" beam 748. Guide rollers 750, 752, 754 and 756 are adapted for maintaining pinion gears 740 and 742 in contact with rack 744 and for bearing lateral loads carried by drive mechanism 174 to prevent damage to pinion gears 740 and 742 and rack 744 due to lateral movements by drive mechanism 174.

The electric power supply for crane 102 is provided by conventional power lines connected to the electric power source of ship 101. These power lines are automatically coiled and uncoiled on cable reel 770 (FIG. 5) as crane 102 moves fore and aft along the length of ship 102. Cable reel 770 is mounted on girder 186 and is entirely conventional in design and construction. Similarly, the electric power lines extending from crane 102 to load frame 172 are coiled and uncoiled on cable reel 772 as load frame 172 is hoisted upwardly or downwardly. Cable reel 772 is mounted on beam 422 and is entirely conventional in design and construction.

Figure 30:
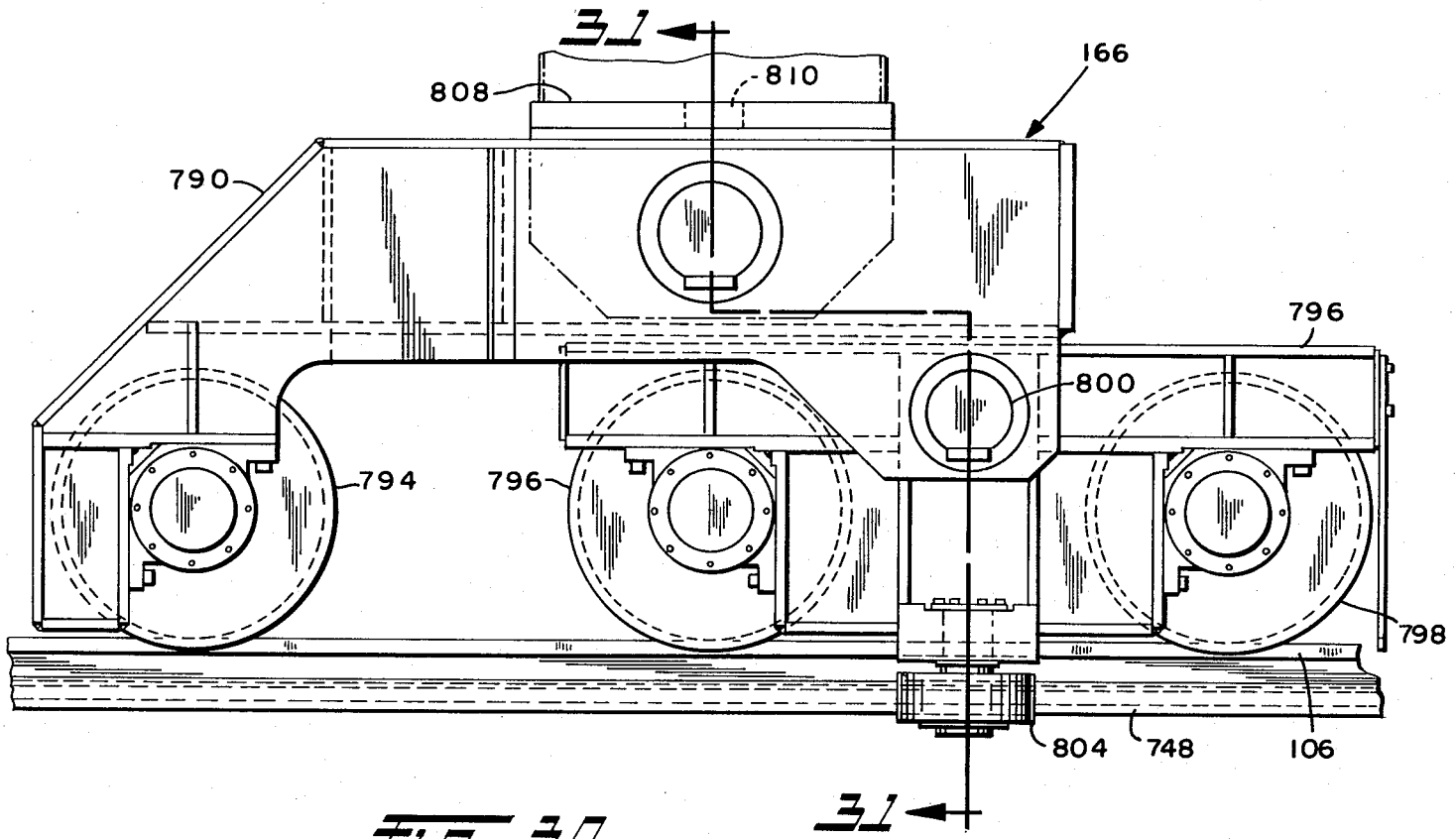
FIG. 30 is an enlarged side elevational view of a traveling carriage for supporting the crane illustrated in FIG. 1.
Figure 31:
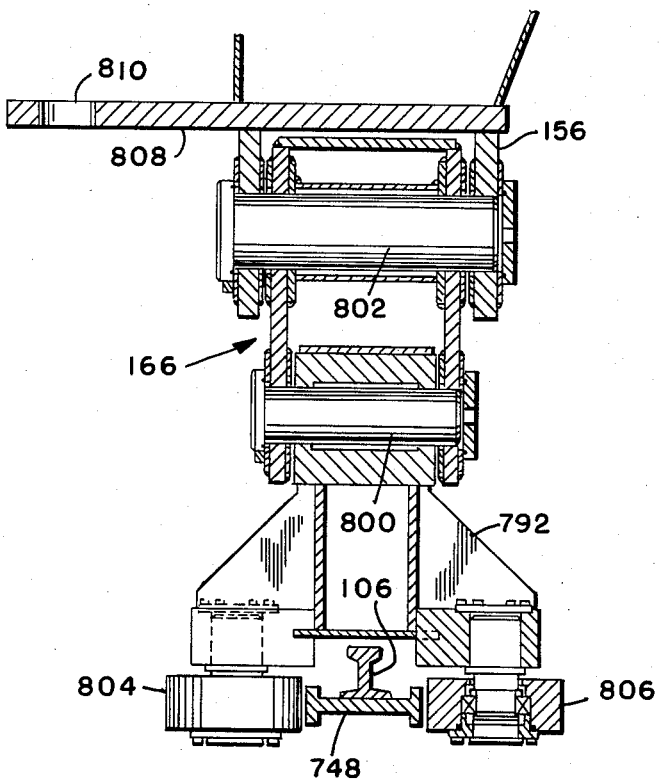
FIG. 31 is a sectional view of the carriage illustrated in FIG. 30 taken along line 31—31 of FIG. 30.

Each of the traveling carriages 160, 162, 164 and 166 are identical in design and construction. Accordingly, the following description of traveling carriage 166, which is best illustrated in FIGS. 30 and 31, is also applicable to traveling carriages 160, 162 and 164. Carriage 166 includes frame members 790 and 792 and wheels 794, 796 and 798 which are of the steel, rail-engaging type and are adapted to ride on rail 106. Wheel 794 is rotatably mounted on frame member 790. Wheels 796 and 798 are mounted on frame member 792. Frame member 792 is pivotally attached to frame member 790 by pin 800. Carriage 166 is pivotally attached to leg member 156 by pin 802. Pins 800 and 802 are positioned so that the weight supported by carriage 166 is evenly distributed between wheels 794, 796 and 798. Carriage 166 also includes a pair of guide rollers 804 and 806 which depend from frame member 792 and engage the starboard side and port side, respectively, of "I" beam 748. Guide rollers 804 and 806 are adapted for bearing lateral loads carried by carriage 166 to prevent such loads from being carried by the flanges of wheels 794, 796 and 798. Carriage 166 also includes horizontally extending plate member 808 which is welded to frame member 790. Plate member 808 includes aperture 810 which is adapted for receiving stowage post 814 of anchoring device 812.

Figure 32:
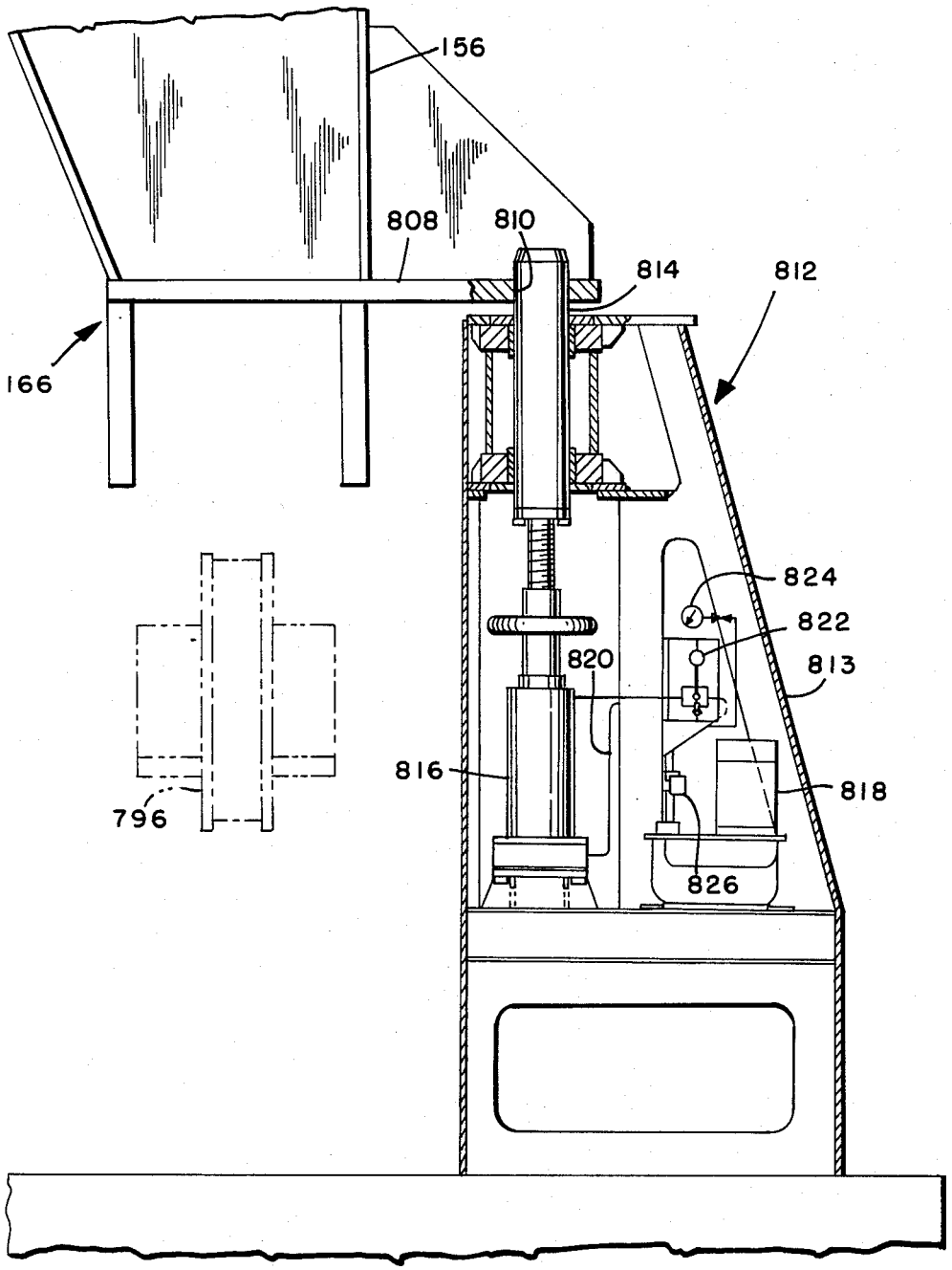
FIG. 32 is an enlarged fragmentary sectional view of an anchoring device for securing the crane illustrated in FIG. 1 to the deck of the ship taken along line 32—32 of FIG. 1, the anchoring device being illustrated with part of one of the supporting legs of the crane and part of one of the traveling carriages of such crane shown in phantom.

Anchoring device 812, which is best illustrated in FIG. 32, is one of four identical anchoring devices which are provided for each of the carriages 160, 162, 164 and 166 and are mounted on the deck of ship 102. Anchoring devices 812 provide a stowage location for crane 102 which can be conveniently located at the forward end of rails 104 and 106 as illustrated in FIG. 1. Two of the anchoring devices 812 are positioned on the port side of rail 104 and are adapted for attachment to carriages 160 and 164, and the other two anchoring devices 812 are positioned on the starboard side of rail 106 and are adapted for attachment to carriages 162 and 166. Additional anchoring devices can be provided on the deck of ship 101 depending upon the number of desired stowage positions for crane 102. Anchoring device 812 includes an anchoring tower 813 and stowage post 814 which is mounted on anchoring tower 813. Stowage post 814 is moved upwardly to project through aperture 810 and thereby engage plate member 808 by means of hydraulic cylinder 816. Hydraulic cylinder 816 is activated by power unit 818 which is connected to hydraulic cylinder 816 through hose 820.

Control valve 822 is provided for activating hydraulic cylinder 816. Pressure gauge 824 is provided for monitoring the pressure within hydraulic cylinder 816 and pressure relief valve 826 is provided for relieving the pressure within hydraulic cylinder 816 or hose 820 in the event such pressure builds beyond a predetermined level. In operation, crane 102 is advanced forwardly along rails 104 and 106 until it is positioned over the four anchoring devices 812 as illustrated in phantom in FIG. 1. Anchoring devices 812 are then activated to attach stowage posts 814 to carriages 160, 162, 164 and 166 and thereby secure crane 102 in a stowed position.

A preferred method for operating the transport system of the present invention includes the following steps. Crane 102 is initially stowed in the anchoring position illustrated in phantom in FIG. 1. Ship 102 is partially submerged so that a sufficient level of water is provided in cargo hold 138 to permit a first layer or row of lighters 136 to be floated into cargo hold 138 through open stern wall 130. Cargo lighters 136 are preferably driven into cargo hold 138 with a tug boat or similar means, such loading practices being well-known to those skilled in the art. Once the first layer of cargo lighters 136 is positioned in hold 138, it is tightened up with a winch assembly or similar mechanism of conventional design. Additionally, each lighter 136 can be secured to hold 138 using conventional anchoring techniques.

Spacers, such as rubber cubes, are preferably provided between each cargo lighter 136 in the first layer. Sufficient spacing of, for example, about 11 or 12 inches, is generally required between each cargo lighter 136 in the first layer to provide sufficient operating room for crane 102 when loading or unloading the second and, optionally, additional layers of cargo lighters on top of the first layer. It will be understood, however, that such spacers are not required. If spacers are not used, the cargo lighters 136 are stored against each other in end-to-end abutting alignment. Under such circumstances crane 102 will not have sufficient operating room to place a lighter 136 on each lighter in the first layer and, consequently, the second and additional layers of lighters will be limited to storing such lighters on top of every other lighter in the first layer.

An alternative means for providing spacing between the lighters 136 stored within cargo hold 138 includes the use of extendable and retractable hull guides 840, which are illustrated in FIGS. 28 and 29. Hull guides 840 are spaced throughout cargo hold 138, a pair of such hull guides 840 being provided on the port side of cargo hold 138, and a corresponding pair of guides 840 on the starboard side of hold 138 for each lighter 136 to be stored. Each of the guides 840 includes a vertically elongated corner guide member 842 which is adapted for engaging one of the corners of lighter 136. Each corner guide member 842 is mounted on a pair of hydraulic support members 844 and 846. Hydraulic support members 844 and 846 are mounted in the hull of cargo hold 138 and project outwardly from hull wall 142. Also attached to corner guide member 842 and mounted in the hull is stabilizer and stop guide rod 848. Stabilizer and stop guide rod 848 also projects outwardly from hull wall 142 and is provided for stabilizing and limiting the lateral movements of corner guide 842. Hull guides 840 are positioned in a retracted mode during the loading of the first layer of cargo lighters 136 into cargo hold 138 to permit lighters 136 to move forwardly within cargo hold 138 without interference from hull guides 840. When lighters 136 reach their required storage location in cargo hold 138, hydraulic members 844 and 846 are activated to move corner guides 842 laterally inwardly to engage the corners of lighters 136 aligned with such corner guides 842. Hull guides 840 can also assist removable and extendable guides 108, 110, 112 and 114 in restraining swinging movement of lighter 136 as it is lowered into hold 138. When it is desired to unload lighters 136 from cargo hold 138, hydraulic members 844 and 846 for each hull guide 840 are again activated to retract hull guides 840 from engaging contact with their respective lighters 136 thus permitting unobstructed rearward movement by such lighters within cargo hold 138. Due to cost considerations, the preferred method for providing spacing between lighters 136 within hold 138 presently appears to involve the use of the rubber cubes mentioned above, rather than hull guides 840.

When the first layer of cargo lighters 136 is secured within cargo hold 138, ship 101 is raised to its floating position by evacuating the ballast tanks of the ship which are positioned throughout the ship between hulls 140 and 142. Tapered sides 840 and 842 (FIG. 3) are provided along the longitudinal length of the starboard and port sides, respectively, of cargo hold 138 to permit cargo lighters 136 to settle on the bottom of hold 138 in tight formation with the sides of hold 138 to secure lighters 136 from lateral movement. As ship 101 is raised, water in hold 138 empties out through open stern wall 130 thus permitting the lighters 136 to settle on the bottom of hold 138. The second and additional layers or rows of cargo lighters 136 can then be transported into cargo hold 138 employing the transport system of the present invention. The anchoring devices 812 are disengaged from crane 102 thus permitting crane 102 to move fore and aft along rails 104 and 106. Crane 102 is moved to its outboard position over the stern of ship 101 on cantilevered beams 122 and 124. Removable guides 126 and 128 are mounted on stern wall 130 using jib cranes 654 and 652, respectively. Removable guides 118 and 120 are mounted on cantilevered beams 122 and 124 using jib cranes 654 and 642, respectively. Vertically extendable and retractable guides 108, 110, 112 and 114 are extended downwardly to their fully extended position by actuation of the drive mechanisms 544 associated with each of such guides. A lighter 136 is moved into the loading well beneath cantilevered beams 122 and 124 and removable guides 118, 120, 126 and 128. The forward corners of lighter 136 contact fixed guides 132 and 134. Load frame 172 is lowered onto lighter 136. Each of the corner posts 475 of lighter 136 are received within respective recesses 478 of load frame 172. When the upper portion of each of the corner posts 475 contact their respective plunger 479, their respective latch pins 481 are activated to engage the corner posts 475 associated therewith thereby securing load frame 172 to the four corner posts 475 of lighter 136.

Lighter 136 is then hoisted upwardly by crane 102. The upward hoisting of load frame 172 and lighter 136 is effected by rotating lifting drums 250 and 252. The rotation of lifting drums 250 and 252 is effected by activating drive mechanism 254. Load frame 172 is usually initially guided by fixed guides 132 and 134, then it is guided by removable guides 118, 120, 126 and 128 and finally by extendable and retractable guides 108, 110, 112 and 114. Once lighter 136 has been hoisted to a level above removable guides 126 and 128 and above any other obstruction in its forward parth such as lighters 136 already stored in hold 138, crane 102 is advanced forwardly along rails 104 and 106 to a desired location over cargo hold 138. During the movement of crane 102, swinging movement by lighter 136 is restrained by vertically extendable and retractable guides 108, 110, 112 and 114 which are maintained in their extended position. Crane 102 is then locked in position on rails 104 and 106 by means of brake mechanisms 724 and 726. Load frame 172 and cargo lighter 136 are lowered into cargo hold 138 by rotating lifting drums 250 and 252 until lighter 136 is positioned on top of one of the lighters 136 in cargo hold 138. The corner posts 475 of the lighter 136 in the hold 138 below the lighter 136 being lowered are received within the recesses 477 of the lighter being lowered, the corner posts 475 thus functioning as a centering and anchoring means for the lighter 136 being lowered. Prior to disengaging load frame 172, the lighter 136 can be further secured to hold 138 by conventional means. Load frame 172 is then disengaged by activating each of the hydraulic cylinders 482 to retract their respective latch pins 481. Load frame 172 is hoisted upwardly by rotating lifting drums 250 and 252. Vertically extendable and retractable guides 108, 110, 112 and 114 are retracted upwardly by activating the drive mechanisms 544 associated with each such extendable and retractable guides. Crane 102 is then advanced rearwardly to its outboard position on cantilevered beams 122 and 124 over the stern of ship 101. Vertically extendable and retractable guides 108, 110, 112 and 114 are extended downwardly by activating the drive mechanisms 544 associated with each of such guides. The next and subsequent cargo lighters 136 to be loaded in cargo hold 138 can then be transported from the loading well adjacent the stern of the ship and below the cantilevered beams 122 and 124 into cargo hold 138 following the foregoing procedure.

It will be understood by those skilled in the art that although it is preferable to load the first layer of cargo lighters by partially submerging ship 101 and floating such cargo lighters into hold 138, the transport system of the present invention can also be employed for loading the first layer of cargo lighters into hold 138 using the foregoing procedure described above, it being understood that under such conditions ship 101 is preferably in its fully floating position (i.e., not partially submerged).

While ship 101 is underway, crane 102 is maintained in its stowed position as indicated in phantom in FIG. 1. When ship 101 reaches its destination the reverse of the foregoing loading procedure is used to unload cargo lighters 136 from hold 138. The anchoring devices 812 are disengaged from crane 102 thus permitting crane 102 to move fore and aft along rails 104 and 106. Crane 102 is moved to its outboard position over the stern of ship 101 on cantilevered beams 122 and 124. Removable guides 126 and 128 are mounted on stern wall 130 using jib cranes 654 and 652, respectively. Removable guides 118 and 120 are mounted on cantilevered beams 122 and 124 using jib cranes 654 and 652, respectively. Crane 102 is moved forwardly along rails 104 and 106 until it is positioned over the first lighter 136 to be unloaded from cargo hold 138. Vertically extendable and retractable guides 108, 110, 112 and 114 are extended downwardly to their fully extended position by activating the drive mechanisms 544 associated with each of such guides. Load frame 172 is lowered onto lighter 136 by rotating lifting drums 250 and 252. Each of the corner posts 475 of lighter 136 are received within their respective recesses 478 of load frame 172. When the upper portion of each of the corner posts 475 contact their respective plungers 479, the latch pins 481 associated with such plungers are activated to engage the corner posts 475 thereby securing load frame 172 to the four corner posts 475 of lighter 136. Lighter 136 is then hoisted upwardly by crane 102. The upward hoisting of load frame 172 and lighter 136 is effected by rotating lifting drums 250 and 252. Swinging movement of lighter 136 is restrained by vertically extendable and retractable guides 108, 110, 112 and 114. Once lighter 136 has been hoisted to a level above all obstructions in the rearward path thereof, crane 102 is moved rearwardly along rails 104 and 106 to its outboard position over the stern of ship 101 on cantilevered beams 122 and 124. During the movement of crane 102, swinging movement of lighter 136 is restrained by vertically extendable and retractable guides 108, 110, 112 and 114. Crane 102 is then locked in position on rails 104 and 106 by means of brake mechanisms 724 and 726. Crane 102 is also restrained from further rearward movement by bumper stops 701 and 703. Load frame 172 and cargo lighter 136 are lowered into the water below cantilevered beams 122 and 124 by rotating lifting drums 250 and 252 until lighter 136 is in a floating position. As load frame 172 is lowered, it is initially guided by vertically extendable and retractable guides 108, 110, 112 and 114, then by removable guides 118, 120, 126 and 128 and finally by fixed guides 132 and 134. Load frame 172 is then disengaged from lighter 136 by activating each of the hydraulic cylinders 482 to retract their respective latch pins 481. Load frame 172 is hoisted upwardly by rotating lifting drums 250 and 252. Lighter 136 is moved away from the stern of ship 101 by a tugboat or similar means. Vertically extendable and retractable guides 108, 110, 112 and 114 are retracted upwardly by activating the drive mechanisms 544 associated with each of such guides. Crane 102 is then advanced forwardly along rails 104 and 106 until it is positioned over the next lighter 136 to be unloaded. The foregoing procedure is repeated until all of the lighters 136 desired to be removed from cargo hold 138 utilizing crane 102 have been removed.

The first or lowest layer of cargo lighters 136 in cargo hold 138 can be unloaded from cargo hold 138 utilizing crane 102 or by partially submerging ship 101 and then floating cargo lighters 136 through the open stern wall 130 of ship 101. In the event cargo lighters 136 are to be removed by floating such lighters through the open stern wall 130 of ship 101, it is necessary to remove removable guides 126 and 128 from stern wall 130 using jib crane 654 and 642, respectively, and to remove removable guides 118 and 120 from cantilevered beams 122 and 124 using jib cranes 654 and 652. Once the removable guides have been removed, it is preferable to move crane 102 to a stowed position such as, for example, the position illustrated in phantom in FIG. 1. Crane 102 is then preferably anchored to its stowed position utilizing anchoring devices 812.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

I claim:

1. A crane for transporting a lighter from a floating position adjacent the stern of a ship to a storage location aboard said ship or for transporting said lighter from said storage location to said floating position comprising:

a hoist support structure of sufficient transverse dimension to span the width of the cargo hold of said ship;

means including wheel means for moving said hoist support structure fore and aft along spaced rails extending longitudinally along opposite sides of said ship;

hoisting means mounted on said hoist support structure;

a load frame suspended by said hoisting means, said load frame including roller guide means, said load frame being adapted for attachment to said lighter; and vertically extendable and retractable load frame guide means depending from said hoist support structure, said extendable and retractable guide means including vertically elongated channel means for engaging said roller guide means, said extendable and retractable guide means being adapted for restraining the swinging movement of said lighter when said lighter is hoisted.

2. The crane of claim 1 wherein said hoist support structure includes a hoist support frame which comprises a rectangular structure with a pair of transverse girders of sufficient length to span the width of said cargo hold and a pair of end girders which extend longitudinally of the ship.

3. The crane of claim 2 wherein said hoist support structure includes leg means for supporting said hoist support frame, and said wheel means comprises traveling carriage means pivotally depending from said leg means.

4. The crane of claim 2 wherein said hoist support structure includes a pair of leg members depending from each of said end girders, and said wheel means comprises a traveling carriage pivotally depending from each of said leg members.

5. The crane of claim 1 wherein said means for moving said hoist support structure includes rack means mounted below and spaced parallel to at least one of said rails, said rack means extending longitudinally along the length of said rail, and pinion drive means for drivingly engaging said rack means, said pinion drive means being suspended from said hoist support structure by link means pivotable in a direction normal to said rack means.

6. The crane of claim 1 wherein said hoisting means comprises lifting drum means and upper sheave means mounted on said hoist support structure, load frame sheave means mounted on said load frame, and a plurality of ropefalls adapted for suspending said load frame from said lifting drum means and said upper sheave means, said ropefalls being attached to said lifting drum means and reeved through said upper sheave means and said load frame sheave means.

7. The crane of claim 6 wherein said lifting drum means comprises a fore lifting drum and an aft lifting drum mounted with a common axis of rotation on said hoist support structure and means for rotating said fore and said aft lifting drums; said upper sheave means comprises a pair of upper fore sheave assemblies, one of said upper fore sheave assemblies being positioned on the port side of said fore lifting drum and the other of said upper fore sheave assemblies being positioned on the starboard side of said fore lifting drum, and a pair of upper aft sheave assemblies, one of said upper aft sheave assemblies being positioned on the port side of said aft lifting drum and the other of said upper aft sheave assemblies being positioned on the starboard side of said aft lifting drum; said load frame sheave means comprises a pair of fore load frame sheave assemblies mounted on said load frame, one of said fore load frame sheave assemblies being positioned on the port side of said load frame and the other of said fore load frame sheave assemblies being positioned on the starboard side of said load frame, and a pair of aft load frame sheave assemblies mounted on said load frame, one of said aft load frame sheave assemblies being positioned on the port side of said load frame and the other of said aft load frame sheave assemblies being positioned on the starboard side of said load frame; at least one ropefall being attached to said fore lifting drum and being reeved through said port side upper fore sheave assembly and said port side fore load frame sheave assembly, at least one ropefall being attached to said fore lifting drum and being reeved through said starboard side upper fore sheave assembly and said starboard side fore load frame sheave assembly, at least one ropefall being attached to said aft lifting drum and being reeved through said port side upper aft sheave assembly and said port side aft load frame sheave assembly, and at least one ropefall being attached to said aft lifting drum and being reeved through said starboard side upper aft sheave assembly and said starboard side aft load frame sheave assembly.

8. The crane of claim 7 with two ropefalls being attached to said fore lifting drum and being reeved through said port side upper fore sheave assembly and said port side fore load frame sheave assembly, two ropefalls being attached to said fore lifting drum and being reeved through said starboard side upper fore sheave assembly and said starboard side fore load frame sheave assembly, two ropefalls being attached to said aft lifting drum and being reeved through said port side upper aft sheave assembly and said port side aft load frame sheave assembly, and two ropefalls being attached to said aft lifting drum and being reeved through said starboard side upper aft sheave assembly and said starboard side aft load frame sheave assembly.

9. The crane of claim 1 wherein said load frame comprises a rectangular structure with starboard side and port side load beams connected by cross tie members, said hoisting means including a pair of load frame sheave assemblies mounted on each of said load beams and at least one ropefall reeved through each of said load frame sheave assemblies, each of said load frame sheave assemblies including pivotable means movable between an upwardly extending load bearing position and a pivoted tension maintaining position and means biasing said pivotable means to said pivoted position to maintain tension in its respective ropefall when said load frame is connected to a lighter being tossed by sea swell.

10. The crane of claim 9 with two ropefalls reeved through each of said load frame sheave assemblies.

11. The crane of claim 9 wherein said pivotable means comprises for each load frame sheave assembly a link member pivotally connected at one end to said load frame sheave assembly and at the other end to the load beam associated with said load frame sheave assembly and said biasing means comprises for each load frame sheave assembly a spring and plunger assembly mounted on the load beam of said load frame sheave assembly and operatively connected to the link member of said load frame sheave assembly, each of said link members being mounted on its respective load beam for pivotal movement in the vertical plane through the longitudinal center line of its respective load beam.

12. The crane of claim 9 with a pair of recesses of pyramidal form in the bottom of each load beam adapted to receive corner posts of pyramidal form extending upwardly from said lighter, said recesses serving as centering and locating means for said corner posts, and latch means on each load beam for securing said corner posts within said recesses.

13. The crane of claim 1 wherein said vertically extendable and retractable load frame guide means comprises a plurality of guide members depending from said hoist support structure and means mounted on said hoist support structure for extending said guide members along a vertical line downwardly and retracting said guide members along said vertical line upwardly, each of said guide members including inwardly opening vertically elongated channel means for receiving cooperative guide means of said load frame to guide the hoisting movement and restrain the swinging movement of said load frame when said load frame is hoisted upwardly or downwardly and/or transported fore or aft.

14. The crane of claim 1 wherein said vertically extendable and retractable load frame guide means comprises a plurality of guide frames depending from said hoist support structure and for each of said guide frames a guide member telescopically receivable within said guide frame and adapted for extending downwardly from said guide frame, each of said guide members being axially movable relative to its respective guide frame, and means mounted on each of said guide frames and extending coaxially downwardly with each of said guide frames for moving each of said guide members on a vertical line upwardly and downwardly relative to its respective guide frame.

15. The crane of claim 1 wherein said vertically extendable and retractable load frame guide means comprises four guide members depending from said hoist support structure and means for extending said guide members along a vertical line downwardly and retracting said guide members along said vertical line upwardly, each of said guide members including an inwardly opening vertically elongated channel member, said load frame including roller means projecting from each corner of said load frame, each of said channel members being adapted for engaging roller means projecting from one of said corners to guide the hoisting movement and restrain the swinging movement of said load frame.

16. The crane of claim 1 wherein said hoist support structure includes a rectangular horizontal support frame and said vertically extendable and retractable load frame guide means comprises a guide frame depending from each corner of said hoist support frame and for each of said guide frames a guide member telescopically receivable within said guide frame and extendable downwardly from said guide frame, each of said guide members being axially movable relative to its respective guide frame, and means mounted on each of said guide frames and extending downwardly within each of said guide frames for moving each of said guide members on a vertical line upwardly and downwardly relative to its respective guide frame.

17. The crane of claim 1 with means for anchoring said crane to the deck of said ship at an anchoring position when the ship is underway, said hoist support structure including a plurality of traveling carriages for supporting said hoist support structure, each of said traveling carriages including an anchoring structure, said anchoring means comprising an anchor tower secured to the deck of said ship adjacent each traveling carriage when said crane is in its anchoring position and vertically movable means carried by each of said anchoring towers and adapted to engage its respective anchoring structure when the crane is in its anchoring position.

18. The crane of claim 17 wherein each of said anchoring structures includes an outwardly extending horizontal plate member and an aperture in each of said plate members, and said vertically movable means for each of said anchoring means includes a vertically extendable and retractable stowage post adapted for projecting through the aperture of its respective anchoring structure to engage the plate member of such anchoring structure, and hydraulic means for extending and retracting said stowage post.

19. A system for transporting a lighter from a floating position adjacent the stern of a ship to a storage location aboard said ship or for transporting said lighter from said storage location to said floating position comprising:

a crane comprising a hoist support structure of sufficient transverse dimension to span the width of the cargo hold of said ship, means including wheel means for moving said hoist support structure fore and aft along spaced rails extending longitudinally along opposite sides of said ship, hoisting means mounted on said hoist support structure, and a load frame suspended by said hoisting means and being adapted for attachment to said lighter, said load frame including roller guide means;

vertically extendable and retractable load frame guide means depending from said hoist support structure, said extendable and retractable guide means including extendable and retractable aft guide members and extendable and retractable fore guide members;

removable guide means removably mountable on said ship, said removable guide means including removable aft guide members removably mountable on cantilevered beams extending rearwardly from the stern of said ship and removable fore guide members removably mountable on the stern of said ship, said removable aft guide members adapted for being positioned below and coaxially aligned with said extendable and retractable aft guide members, said removable fore guide members adapted for being positioned below and coaxially aligned with said extendable and retractable fore guide members; and fixed guide means mounted on the stern of said ship, said fixed guide means including fixed fore guide members adapted for being positioned below and coaxially with said removable fore guide members;

said vertically extendable and retractable load frame guide means, said removable guide means and said fixed guide means including vertically elongated channel means for engaging said roller guide means and being adapted for restraining the swinging movement of said lighter when said lighter is hoisted.

20. The system of claim 19 wherein spacer means is provided in said cargo hold between each lighter stored therein to provide sufficient operating rooms for said crane when loading or unloading adjacent lighters.

21. The system of claim 19 wherein said load frame is a rectangular structure with horizontally projecting roller means extending from each of its corners; said vertically extendable and retractable load frame guide means includes a pair of extendable and retractable aft guide members and a pair of extendable and retractable fore guide members, each of said extendable and retractable guide members including vertically elongated channel means adapted for engaging the roller means extending from one of said corners; said removable guide means including a pair of removable aft guide members and a pair of removable fore guide members, each of said removable guide members including vertically elongated channel means adapted for engaging the roller means extending from one of said corners; and said fixed guide means including a pair of fore guide members, each of said fore guide members including vertically elongated channel means adapted for engaging one of the roller means extending from one of the corners on the forward end of said load frame.

22. The system of claim 19 wherein an opening of sufficient vertical extent is provided between the top portions of said removable fore guide members and the bottom portions of said vertically extendable and retractable fore guide members to permit the forward movement of said lighter when said lighter is transported forward into the cargo hold of said ship, and an opening of sufficient vertical extent is provided between the bottom portions of said removable aft guide members and the floating position of said lighter to permit said lighter to float under said removable aft guide members.

23. The system of claim 19 wherein said hoist support structure includes a hoist support frame which comprises a rectangular structure with a pair of transverse girders of sufficient length to span the width of said cargo hold and a pair of end girders which extend longitudinally of the ship.

24. The system of claim 23 wherein said hoist support structure includes leg means for supporting said hoist support frame, and said wheel means comprises traveling carriage means pivotally depending from said leg means.

25. The system of claim 23 wherein said hoist support structure includes a pair of leg members depending from each of said transverse girders, and said wheel means comprises a traveling carriage pivotally depending from each of said leg members.

26. The system of claim 19 wherein said means for moving said hoist support structure includes rack means mounted below and spaced parallel to at least one of said rails, said rack means extending longitudinally along the length of said rail, and pinion drive means for drivingly engaging said rack means, said pinion drive means being suspended from said hoist support structure by link means pivotable in a direction normal to said rack means.

27. The system of claim 19 wherein said hoisting means comprises lifting drum means and upper sheave means mounted on said hoist support structure, load frame sheave means mounted on said load frame, and a plurality of ropefalls adapted for suspending said load frame from said lifting drum means and said upper sheave means, said ropefalls being attached to said lifting drum means and reeved through said upper sheave means and said load frame sheave means.

28. The system of claim 27 wherein said lifting drum means comprises a fore lifting drum and an aft lifting drum mounted with a common axis of rotation on said hoist support structure and means for rotating said fore and said aft lifting drums; said upper sheave means comprises a pair of upper fore sheave assemblies, one of said upper fore sheave assemblies being positioned on the port side of said fore lifting drum and the other of said upper fore sheave assemblies being positioned on the starboard side of said fore lifting drum, and a pair of upper aft sheave assemblies, one of said upper aft sheave assemblies being positioned on the port side of said aft lifting drum and the other of said upper aft sheave assemblies being positioned on the starboard side of said aft lifting drum; said load frame sheave means comprises a pair of fore load frame sheave assemblies mounted on said load frame, one of said fore load frame sheave assemblies being positioned on the port side of said load frame and the other of said fore load frame sheave assemblies being positioned on the starboard side of said load frame, and a pair of aft load frame sheave assemblies mounted on said load frame, one of said aft load frame sheave assemblies being positioned on the port side of said load frame and the other of said aft load frame sheave assemblies being positioned on the starboard side of said load frame; at least one ropefall being attached to said fore lifting drum and being reeved through said port side upper fore sheave assembly and said port side fore load frame sheave assembly, at least one ropefall being attached to said fore lifting drum and being reeved through said starboard side upper fore sheave assembly and said starboard side fore load frame sheave assembly, at least one ropefall being attached to said aft lifting drum and being reeved through said port side upper aft sheave assembly and said port side aft load frame sheave assembly, and at least one ropefall being attached to said aft lifting drum and being reeved through said starboard side upper aft sheave assembly and said starboard side aft load frame sheave assembly.

29. The system of claim 28 with two ropefalls being attached to said fore lifting drum and being reeved through said port side upper fore sheave assembly and said port side fore load frame sheave assembly, two ropefalls being attached to said fore lifting drum and being reeved through said starboard side upper fore sheave assembly and said starboard side fore load frame sheave assembly, two ropefalls being attached to said aft lifting drum and being reeved through said port side upper aft sheave assembly and said port side aft load frame sheave assembly, and two ropefalls being attached to said aft lifting drum and being reeved through said starboard side upper aft sheave assembly and said starboard side aft load frame sheave assembly.

30. The system of claim 19 wherein said load frame comprises a rectangular structure with starboard side and port side load beams connected by cross tie members, said hoisting means including a pair of load frame sheave assemblies mounted on each of said load beams and at least one ropefall reeved through each of said load frame sheave assemblies, each of said load frame sheave assemblies including pivotable means movable between an upwardly extending load bearing position and a pivotal tension maintaining position and means biasing said pivotable means to said pivoted position to maintain tension in its respective ropefall when said load frame is connected to a lighter being tossed by sea swell.

31. The system of claim 30 two ropefalls reeved through each of said load frame sheave assemblies.

32. The system of claim 30 wherein said pivotable means comprises for each load frame sheave assembly a link member pivotally connected at one end to said load frame sheave assembly and at the other end to the load beam associated with said load frame sheave assembly and said biasing means comprises for each load frame sheave assembly a spring and plunger assembly mounted on the load beam of said load frame sheave assembly and operatively connected to the link member of said load frame sheave assembly, each of said link members being mounted on its respective load beam for pivotal movement in the vertical plane through the longitudinal center line of its respective load beam.

33. The system of claim 30 with a pair of recesses of pyramidal form in the bottom of each load beam adapted to receive corner posts of pyramidal form extending upwardly from said lighter, said recesses serving as centering and locating means for said corner posts, and latch means on each load beam for securing said corner posts within said recesses.

34. The system of claim 19 wherein said vertically extendable and retractable load frame guide means comprises a plurality of guide frames depending from said hoist support structure and for each of said guide frames a guide member telescopically receivable within said guide frame and extending downwardly from said guide frame, each of said guide members being axially movable relative to its respective guide frame, and means mounted on each of said guide frames and extending coaxially downwardly with each of said guide frames for moving each of said guide members on a vertical line upwardly and downwardly relative to its respective guide frame.

35. The system of claim 19 wherein said vertically extendable and retractable load frame guide means comprises a guide frame depending from each corner of said hoist support structure and for each of said guide frames a guide member telescopically receivable within said guide frame and extending downwardly from said guide frame, each of said guide members being axially movable relative to its respective guide frame, and means mounted on each of said guide frames and extending coaxially with each of said guide frames for moving each of said guide members on a vertical line upwardly and downwardly relative to its respective guide frame.

* * * * *